US010648683B2

(12) United States Patent
Cuaderno et al.

(10) Patent No.: US 10,648,683 B2
(45) Date of Patent: May 12, 2020

(54) INTELLIGENT CLIMATE MANAGEMENT SYSTEM CONTROL SYSTEMS AND METHODS

(71) Applicant: Mars Air Systems, LLC, Gardena, CA (US)

(72) Inventors: Frank R. Cuaderno, Aliso Viejo, CA (US); Nagarajan Thiyagarajan, Gardena, CA (US); Steven M. Rosol, Irvine, CA (US)

(73) Assignee: Mars Air Systems, LLC, Aliso Viejo, CA (US)

( * ) Notice: Subject to any disclaimer, the term of this patent is extended or adjusted under 35 U.S.C. 154(b) by 303 days.

(21) Appl. No.: 15/283,048

(22) Filed: Sep. 30, 2016

(65) Prior Publication Data

US 2018/0023825 A1 Jan. 25, 2018

Related U.S. Application Data

(60) Provisional application No. 62/364,261, filed on Jul. 19, 2016.

(51) Int. Cl.

| | |
|---|---|
| ***F24F 9/00*** | (2006.01) |
| ***F24F 11/62*** | (2018.01) |
| *F24F 110/40* | (2018.01) |
| *F24F 110/20* | (2018.01) |
| *F24F 110/00* | (2018.01) |
| *F24F 120/10* | (2018.01) |
| *F24F 110/10* | (2018.01) |

(52) U.S. Cl.

CPC ..... *F24F 9/00* (2013.01); *F24F 11/62* (2018.01); *F24F 2110/00* (2018.01); *F24F 2110/10* (2018.01); *F24F 2110/20* (2018.01); *F24F 2110/40* (2018.01); *F24F 2120/10* (2018.01)

(58) Field of Classification Search

CPC ..... F24F 9/00; F24F 11/62; F24F 2110/00; F24F 2110/20; F24F 2110/40; F24F 2120/10

See application file for complete search history.

(56) References Cited

U.S. PATENT DOCUMENTS

| | | | | |
|---|---|---|---|---|
| 2014/0318375 | A1* | 10/2014 | Ray | F24F 9/00 96/60 |
| 2016/0146485 | A1* | 5/2016 | Weening | F24F 11/00 454/188 |
| 2017/0227244 | A1* | 8/2017 | Thomas, Jr. | F24F 9/00 |

* cited by examiner

*Primary Examiner* — Carlos R Ortiz Rodriguez
*Assistant Examiner* — Vincent W Chang
(74) *Attorney, Agent, or Firm* — Sheppard, Mullin, Richter & Hampton LLP

(57) ABSTRACT

The systems and methods described herein may automatically sense varying environmental factors in an area of interest managed by a climate management system. The systems and methods described herein may adaptively control motors, inlets, outlets, other components of the climate control system, time delay(s), hours of operation, etc. to optimize the performance of the climate control system for the environmental factors. In some implementations, the systems and methods described herein may allow a user full control of climate management systems based on external sensors, building and/or other operational requirements for specific applications/contexts, etc. The systems and methods described herein may support one or more present sequences of operations used for various applications/contexts, and/or may allow users to customize various aspects of operation.

36 Claims, 11 Drawing Sheets

100c

INTELLIGENT CLIMATE MANAGEMENT SYSTEM CONTROL SYSTEMS AND METHODS

CROSS-REFERENCE TO RELATED APPLICATIONS

The present application claims the benefit of U.S. Provisional Patent Application Ser. No. 62/364,261, filed Jul. 19, 2016 and entitled "Intelligent Air Curtain Control Systems and Methods," which is incorporated by reference herein.

BACKGROUND

Climate management systems, such as air curtains and HVAC systems, have been in use for some time. Many climate management systems include machinery to manage a climate in an area of interest. Air curtain systems and many HVAC systems, for instance, may include machinery to cause or to prevent air from moving into or out of an area of interest. These climate management systems may be used to prevent hot or cold air from entering a specific area or to retain hot or cold air in a specific area. These climate management systems may include various physical components, including inlet(s), outlet(s), and air curtain motors that cause air to circulate.

Conventionally, the mechanisms used to control many climate management systems were rudimentary. As an example, the air curtain motors of air curtains used to prevent air from entering a specific area (a building, a specific room, etc.) may be activated by a switch that is triggered when a door opens, and may be deactivated in response to a time delay after the door closes. Conventional air curtain control mechanisms may waste energy, may lack automation, and may not allow building administrators and/or others a sufficiently granular level of control.

SUMMARY

Intelligent climate management is intended to include, by way of example but not limitation, the management of air curtains and HVAC systems (e.g., rooftop Air Conditioning (AC) units, exhaust hoods, Variable Air Volume (VAV) systems etc.), to name several examples. In various implementations, the systems and methods described herein automatically sense varying environmental factors in an area of interest managed by a climate management system. The systems and methods described herein may adaptively control motors, inlets, outlets, other components of the climate control system, time delay(s), hours of operation, etc. to optimize the performance of the climate control system for the environmental factors. In some implementations, the systems and methods described herein may allow a user full control of climate management systems based on external sensors, building and/or other operational requirements for specific applications/contexts, etc. The systems and methods described herein may support one or more present sequences of operations used for various applications/contexts, and/or may allow users to customize various aspects of operation.

DETAILED DESCRIPTION

Figure 1A:
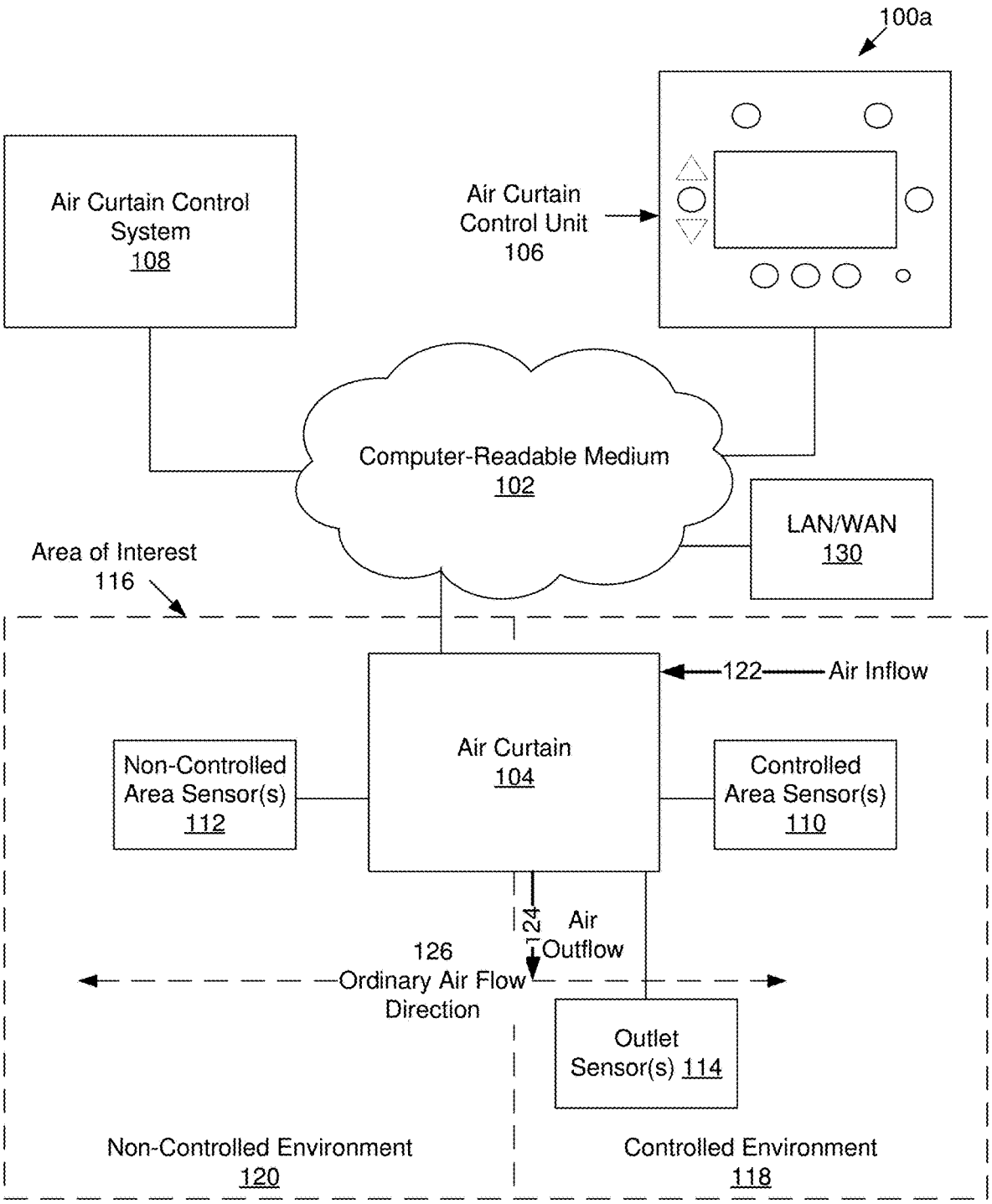
FIG. 1A depicts a diagram of an example of an air curtain control environment.

FIG. 1A depicts a diagram of an example of an air curtain control environment 100A. In the example of FIG. 1A, the air curtain control environment 100A includes a computer-readable medium 102, an air curtain 104, an air curtain control unit 106, an air curtain control system 108, controlled area sensor(s) 110, non-controlled area sensor(s) 112, and outlet sensor(s) 114. The air curtain control environment 100A may further include an area of interest 116 around the air curtain 104.

In the example of FIG. 1A, the computer-readable medium 102 is coupled to the air curtain 104, the air curtain control unit 106, and the air curtain control system 108. The computer-readable medium 102 and other computer readable media discussed in this paper are intended to represent a variety of potentially applicable technologies. For example, the computer-readable medium 102 can be used to form a network or part of a network. Where two components are co-located on a device, the computer-readable medium 102 can include a bus or other data conduit or plane. Where a first component is co-located on one device and a second component is located on a different device, the computer-readable medium 102 can include a wireless or wired back-end network or LAN (e.g., a portion of LAN/WAN 130). The computer-readable medium 102 can also encompass a relevant portion of a WAN (e.g., a portion of LAN/WAN 130) or other network, if applicable. The computer-readable medium 102 and other applicable systems or devices described in this paper can be implemented as a computer system or parts of a computer system or a plurality of computer systems. In general, a computer system will include a processor, memory, non-volatile storage, and an interface. A typical computer system will usually include at least a processor, memory, and a device (e.g., a bus) coupling the memory to the processor. The processor can be, for example, a general-purpose central processing unit (CPU), such as a microprocessor, or a special-purpose processor, such as a microcontroller.

The memory can include, by way of example but not limitation, random access memory (RAM), such as dynamic RAM (DRAM) and static RAM (SRAM). The memory can be local, remote, or distributed. The bus can also couple the processor to non-volatile storage. The non-volatile storage is often a magnetic floppy or hard disk, a magnetic-optical disk, an optical disk, a read-only memory (ROM), such as a CD-ROM, EPROM, or EEPROM, a magnetic or optical card, or another form of storage for large amounts of data.

Some of this data is often written, by a direct memory access process, into memory during execution of software on the computer system. The non-volatile storage can be local, remote, or distributed. The non-volatile storage is optional because systems can be created with all applicable data available in memory.

Software is typically stored in the non-volatile storage. Indeed, for large programs, it may not even be possible to store the entire program in the memory. Nevertheless, it should be understood that for software to run, if necessary, it is moved to a computer-readable location appropriate for processing, and for illustrative purposes, that location is referred to as the memory in this paper. Even when software is moved to the memory for execution, the processor will typically make use of hardware registers to store values associated with the software, and local cache that, ideally, serves to speed up execution. As used herein, a software program is assumed to be stored at an applicable known or convenient location (from non-volatile storage to hardware registers) when the software program is referred to as "implemented in a computer-readable storage medium." A processor is considered to be "configured to execute a program" when at least one value associated with the program is stored in a register readable by the processor.

In one example of operation, a computer system can be controlled by operating system software, which is a software program that includes a file management system, such as a disk operating system. One example of operating system software with associated file management system software is the family of operating systems known as Windows® from Microsoft Corporation of Redmond, Wash., and their associated file management systems. Another example of operating system software with its associated file management system software is the Linux operating system and its associated file management system. The file management system is typically stored in the non-volatile storage and causes the processor to execute the various acts required by the operating system to input and output data and to store data in the memory, including storing files on the non-volatile storage.

The bus can also couple the processor to the interface. The interface can include one or more input and/or output (I/O) devices. Depending upon implementation-specific or other considerations, the I/O devices can include, by way of example but not limitation, a keyboard, a mouse or other pointing device, disk drives, printers, a scanner, and other I/O devices, including a display device. The display device can include, by way of example but not limitation, a cathode ray tube (CRT), liquid crystal display (LCD), or some other applicable known or convenient display device. The interface can include one or more of a modem or network interface. It will be appreciated that a modem or network interface can be considered to be part of the computer system. The interface can include an analog modem, ISDN modem, cable modem, token ring interface, satellite transmission interface (e.g. "direct PC"), or other interfaces for coupling a computer system to other computer systems. Interfaces enable computer systems and other devices to be coupled together in a network.

The computer systems can be compatible with or implemented as part of or through a cloud-based computing system. As used in this paper, a cloud-based computing system is a system that provides virtualized computing resources, software and/or information to end user devices. The computing resources, software and/or information can be virtualized by maintaining centralized services and resources that the edge devices can access over a communication interface, such as a network. "Cloud" may be a marketing term and for the purposes of this paper can include any of the networks described herein. The cloud-based computing system can involve a subscription for services or use a utility pricing model. Users can access the protocols of the cloud-based computing system through a web browser or other container application located on their end user device.

A computer system can be implemented as an engine, as part of an engine or through multiple engines. As used in this paper, an engine includes one or more processors or a portion thereof. A portion of one or more processors can include some portion of hardware less than all of the hardware comprising any given one or more processors, such as a subset of registers, the portion of the processor dedicated to one or more threads of a multi-threaded processor, a time slice during which the processor is wholly or partially dedicated to carrying out part of the engine's functionality, or the like. As such, a first engine and a second engine can have one or more dedicated processors or a first engine and a second engine can share one or more processors with one another or other engines. Depending upon implementation-specific or other considerations, an engine can be centralized or its functionality distributed. An engine can include hardware, firmware, or software embodied in a computer-readable medium for execution by the processor. The processor transforms data into new data using implemented data structures and methods, such as is described with reference to the FIGS. in this paper.

The engines described in this paper, or the engines through which the systems and devices described in this paper can be implemented, can be cloud-based engines. As used in this paper, a cloud-based engine is an engine that can run applications and/or functionalities using a cloud-based computing system. All or portions of the applications and/or functionalities can be distributed across multiple computing devices, and need not be restricted to only one computing device. In some embodiments, the cloud-based engines can execute functionalities and/or modules that end users access through a web browser or container application without having the functionalities and/or modules installed locally on the end-users' computing devices.

As used in this paper, datastores are intended to include repositories having any applicable organization of data, including tables, comma-separated values (CSV) files, traditional databases (e.g., SQL), or other applicable known or convenient organizational formats. Datastores can be implemented, for example, as software embodied in a physical computer-readable medium on a specific-purpose machine, in firmware, in hardware, in a combination thereof, or in an applicable known or convenient device or system. Datastore-associated components, such as database interfaces, can be considered "part of" a datastore, part of some other system component, or a combination thereof, though the physical location and other characteristics of datastore-associated components is not critical for an understanding of the techniques described in this paper.

Datastores can include data structures. As used in this paper, a data structure is associated with a particular way of storing and organizing data in a computer so that it can be used efficiently within a given context. Data structures are generally based on the ability of a computer to fetch and store data at any place in its memory, specified by an address, a bit string that can be itself stored in memory and manipulated by the program. Thus, some data structures are based on computing the addresses of data items with arithmetic operations; while other data structures are based on storing addresses of data items within the structure itself. Many data structures use both principles, sometimes combined in non-trivial ways. The implementation of a data structure usually entails writing a set of procedures that create and manipulate instances of that structure. The datastores, described in this paper, can be cloud-based datastores. A cloud-based datastore is a datastore that is compatible with cloud-based computing systems and engines.

In some implementations, the computer-readable medium 102 includes a Building Automation and Control network (BACnet). In some implementations, the BACnet is a communications protocol for building automation and control networks. The BACnet may comprise an ASHRAE, ANSI, and ISO 16484-5 standard protocol. In various implementations, the computer-readable medium 102 may be designed to allow communication of building automation and control systems for applications such as heating, ventilating, and air-conditioning control (HVAC), lighting control, access control, and fire detection systems and their associated equipment. Relevant BACnet protocol(s) may provide mechanisms for computerized building automation devices to exchange information, regardless of the particular building service they perform. In some implementations, the BACnet protocol(s) define a number of services that are used to communicate between building devices. The protocol service(s) may include Who-Is, I-Am, Who-Has, I-Have, which are used for Device and Object discovery. Services such as Read-Property and Write-Property may be used for data sharing. The BACnet protocol may define a number of Objects that are acted upon by the services. The Object may include Analog Input, Analog Output, Analog Value, Binary Input, Binary Output, Binary Value, Multi-State Input, Multi-State Output, Calendar, Event-Enrollment, File, Notification-Class, Group, Loop, Program, Schedule, Command, and Device, etc. BACnet protocol(s) may define one or more data link/physical layers, including ARCNET, Ethernet, BACnet/IP, Point-To-Point over RS-232, Primary-Secondary/Token-Passing over RS-485, and LonTalk, for instance.

In the example of FIG. 1A, the air curtain 104 is coupled to the computer-readable medium 102, the controlled area sensor(s) 110, the non-controlled area sensor(s) 112, and the outlet sensor(s) 114. The air curtain 104 may comprise a device configured to prevent air, pests, contaminants, or other items from moving from one open space to another. In some implementations, the air curtain 104 separates the area of interest 116 into a controlled environment 118 and a non-controlled environment 120. In these implementations, the air curtain 104 may receive an air inflow 122 from the controlled environment 118 and discharge an air outflow 124 into the controlled environment 118. The air outflow 124 may be orthogonal to an ordinary air flow direction 126 of air that flows between the controlled environment 118 and the non-controlled environment 120. Being orthogonal to the ordinary air flow direction 126, the air outflow may create a barrier of air that prevents air, pests, contaminants, etc. from moving between the controlled environment 118 and the non-controlled environment 120. In various implementations, the air curtain 104 may include air inlet(s), air outlet(s), air curtain motor(s), heater(s), sensor interfaces, control engines, and/or network interfaces. The air curtain 104 may include one or more of the components shown in FIG. 2.

In the example of FIG. 1A, the air curtain control unit 106 is coupled to the computer-readable medium 102. In various implementations, the air curtain control unit 106 is configured to provide instructions to control the air curtain 104. The air curtain control unit 106 may include one or more buttons and/or visual displays. In some implementations, the air curtain control unit 106 comprises a touchscreen display configured to provide instructions to control the air curtain 104. The air curtain control unit 106 may include any digital device in various implementations. As examples, the air curtain control unit 106 may include a dedicated wireless remote controller, a mobile phone (e.g., a phone having cellular and/or wireless network capabilities), a tablet computing device, a laptop computer, or a desktop computer, or some combination thereof. In various implementations, the air curtain control unit 106 may be included as part of a Building Management System (BMS) or other system used to control air curtains in multiple rooms, multiple units, and/or multiple buildings. The air curtain control unit 106 may include one or more of the components shown in FIG. 3.

In the example of FIG. 1A, the air curtain control system 108 is coupled to the computer-readable medium 102. The air curtain control system 108 may be configured to process instructions to control the air curtain 104 based on input into the air curtain control system 108. It is explicitly noted that while the figures and detailed description show the air curtain control system 108 and the air curtain control unit 106 as residing on different devices, at least some of the functionalities described with reference to the air curtain control system 108 and the air curtain control unit 106 may be performed on the same device; in some implementations, the air curtain control system 108 and the air curtain control unit 106 are on a single device or on a single set of devices managed by a common entity. In various implementations, the air curtain control system 108 automates the use of the air curtain 104. The air curtain control system 108 may include one or more of the components shown in FIG. 4.

In the example of FIG. 1A, the controlled area sensor(s) 110 are coupled to the air curtain 104. The controlled area sensor(s) 110 may include one or more devices configured to sense a physical property inside the controlled environment 118 and to provide a sensor signal that represents the physical property to the air curtain 104. In some implementations, the controlled area sensor(s) 110 comprise temperature sensors configured to sense a temperature inside the controlled environment 118. The controlled area sensor(s) 110 may comprise one or more humidity sensors configured to sense humidity inside the controlled environment 118. The controlled area sensor(s) 110 may comprise motion sensors (e.g., person movement sensors, door monitors, etc.) that sense movement in the controlled environment 118. The controlled area sensor(s) 110 may comprise of temperature sensors to sense temperature inside the controlled environment 118. The controlled area sensor(s) 110 may comprise of pressure sensors to sense pressure inside the controlled environment 118. While in some implementations, the controlled area sensor(s) 110 may be located near an air inlet of the air curtain 104, it is noted that in various not necessarily distinct implementations, the controlled area sensor(s) 110 are located away from the air curtain 104 in order to accurately assess physical properties of the controlled environment 118.

In the example of FIG. 1A, the non-controlled area sensor(s) 112 are coupled to the air curtain 104. The non-controlled area sensor(s) 112 may sense a physical property inside the non-controlled environment 120 and to provide a sensor signal that represents the physical property to the air curtain 104. The non-controlled area sensor(s) 112 may include temperature sensors, humidity sensors, motion sensors, opacity sensors (e.g., devices configured to measure impenetrability to electromagnetic or other kinds of radiation, e.g., visible light), pressure sensors, etc. In the example of FIG. 1A, the outlet sensor(s) 114 are coupled to the air curtain 104. The outlet sensor(s) 114 may sense a physical property related to the air outflow 124. In some implementations, the outlet sensor(s) 114 are configured to sense a temperature, a humidity, motion, pressure, opacity sensors, pressure sensors, etc. of the air outflow 124. The non-controlled area sensor(s) 112 may be located near the air curtain 104 (e.g., near an air outlet of the air curtain 104), and/or located away from the air curtain 104 in order to accurately assess physical properties of the non-controlled environment 120.

While FIG. 1A shows the controlled area sensor(s) 110, the non-controlled area sensor(s) 112, and the outlet sensor(s) 114 as coupled to the air curtain 104, in various implementations, at least some of these sensors may be coupled to the computer-readable medium. 102. In some implementations, at least some of these sensors may be incorporated into the air curtain 104. It is noted the controlled area sensor(s) 110, the non-controlled area sensor(s) 112, and the outlet sensor(s) 114 may be arranged in other manners without departing from the scope and substance of the inventive concepts described herein.

In various implementations, the systems and methods described herein may operate to intelligently automate use of the air curtain 104. In various implementations, the air curtain control unit 106 may receive instructions to set environmental factors of the controlled environment 118 to desired values. "Environmental factor(s)," as used herein, may include any aspect of an area of interest around an air curtain (e.g., the controlled environment 118) that would be relevant to the operation of the air curtain. Environmental factors may be "measured," e.g., taken from sensors and/or other inputs that can evaluate physical properties in/around the area of interest, and/or "estimated," e.g., approximated. Environmental factors may be "desired," e.g., identified as value(s) in the controlled environment 118 that the air curtain 104 may be instructed to produce. Desired environmental factors may correspond to temperature settings, humidity settings, air flow settings (the extent air flow cycles through an area of interest, the pressure of air flow, air flow speed/volume, air flow angle(s), etc.), etc. in an environment that result from controlling the air curtain 104. The air curtain control unit 106 may provide instructions to set desired environmental factors to the air curtain control system 108.

In some implementations, desired environmental factors may be based one or more air curtain modes of operation. "Air curtain modes of operation," as used herein, may include categories of desired environmental factors for various applications/contexts. In some implementations, the desired environmental factors may be based on a time delay mode of operation where an air curtain motor and/or heater of the air curtain 104 will run when a door is open and will turn off with time delay when the door closes. In these implementations, a door monitoring sensor may determine a rate of estimated and/or measured ingress and/or egress, and the air curtain 104 may instruct an air curtain motor and/or heater to keep running for a specified duration of time after the door has been closed. The desired environmental factors may be based on a modified time delay mode of operation where an air curtain motor and/or heater of the air curtain 104 will run for a specified time after a door has been opened, and will not run for a specified time after the door has been closed. The desired environmental factors may be based on a comfort mode of operation where an air curtain motor and/or heater of the air curtain 104 will run at full speed when a door is open and will run at a lower speed when the door closes. The desired environmental factors may be based on an automatic ecological mode of operation with time delay where an air curtain motor and/or heater of the air curtain 104 will run only if a door is open during specified times of day, thereby reducing energy usage and/or energy costs. As an example, the desired environmental factors may be configured to minimize energy loss(es) through an opening of the air curtain 104.

In some implementations, the desired environmental factors may be based on a heat-on-demand mode of operation with time delay where a heater of the air curtain 104 will run if a door is closed and a thermostat calls for heat. In some implementations, the desired environmental factors may be based on a heat-on-demand automatic ecological mode of operation with time delay where a heater and the air curtain 104 will run even if a door is closed, but a thermostat calls for heat. The heater and air curtain 104 will remain on until the thermostat setpoint is reached, thus turning off the heat and air curtain 104. In various implementations, the desired environmental factors may be based on a primary and secondary mode of operation where operation of air curtain motors and/or heaters of secondary air curtain(s) 104 is based on operation of an air curtain motor and/or heater of a primary air curtain 104. In various implementations, the desired environmental factors may be based on custom modes of operation where operation of air curtain motors and/or heaters of the air curtain 104 are based on user input and/or user settings. In various implementations, the desired environmental factors may be based on stack-effect mode of operation where air curtain motors and/or heaters of the air curtain 104 will be configured to compensate for stack effects in a building; these settings may depend on, e.g., ceiling height, shaft effects, number of stories, and wind tunnel effects. Readings from the temperature and/or pressure sensors may activate the air curtain 104 and heat to operate in multiple combinations, i.e., high speed with high heat, high speed with low heat, low speed with low heat, etc. . . . .

In various implementations, desired environmental factors may be determined based on evaluation of sensor data collected by sensors, e.g., the controlled area sensor(s) 110, the non-controlled area sensor(s) 112, and/or the outlet sensor(s) 114. The sensor data may be evaluated for pressure, humidity, temperature, cycle, and/or other values. In some implementations, desired environmental factors may be classified into one or more states. Sensor data may be associated with each state and/or climate zones based on the geographic region entered by the customer upon receipt of the air curtain control unit 106. To the extent sensor data does not change a state of the desired environmental factors, that sensor data may be disregarded as noise/fluctuations.

The air curtain control system 108 may operate to instruct the air curtain 104 to set desired environmental factors based on instructions provided to the air curtain control unit 106 and based on sensor signals from the controlled area sensor(s) 110, the non-controlled area sensor(s) 112, and the outlet sensor(s) 114. In some implementations, the air curtain control system 108 may receive from the controlled area sensor(s) 110, the non-controlled area sensor(s) 112, and the outlet sensor(s) 114 sensor signals containing representations of measured environmental factors. Examples of such measured environmental factors include measured temperature values and/or measured humidity values taken at various locations in or near the air curtain (outside a controlled area whose climate is controlled by the—air curtain, inside a controlled area whose climate is controlled by the air curtain, within a nozzle discharge area of the air curtain, etc.). Additional examples of measured environmental factors include measured time values taken from a clock coupled to the air curtain and sensors that measure ingress, egress, and/or other door activity at a door that separates a controlled area whose climate is controlled by the air curtain. The air curtain control system 108 may operate to compare the desired environmental factors and the measured/estimated environmental factors and to identify environmental factor deviations, which may include any deviation of the measured/estimated environmental factors from their desired counterparts. One or more air curtain components (e.g., heaters, air curtain motors, air inlets, air outlets) of the air curtain 104 that can implement the environmental factor correction may be identified. The air curtain control system 108 may instruct the one or more air curtain control components to implement the environmental factor correction. In various implementations, control circuitry in the air curtain 104 may operate to instruct the components of the air curtain 104 to implement appropriate environmental factor correction(s). The environmental factor correction(s) may be reflected in changes to air speed, air flow angle, changes in time delay, and/or changes to application of heat/cooling in the air outflow 124.

Figure 1B:
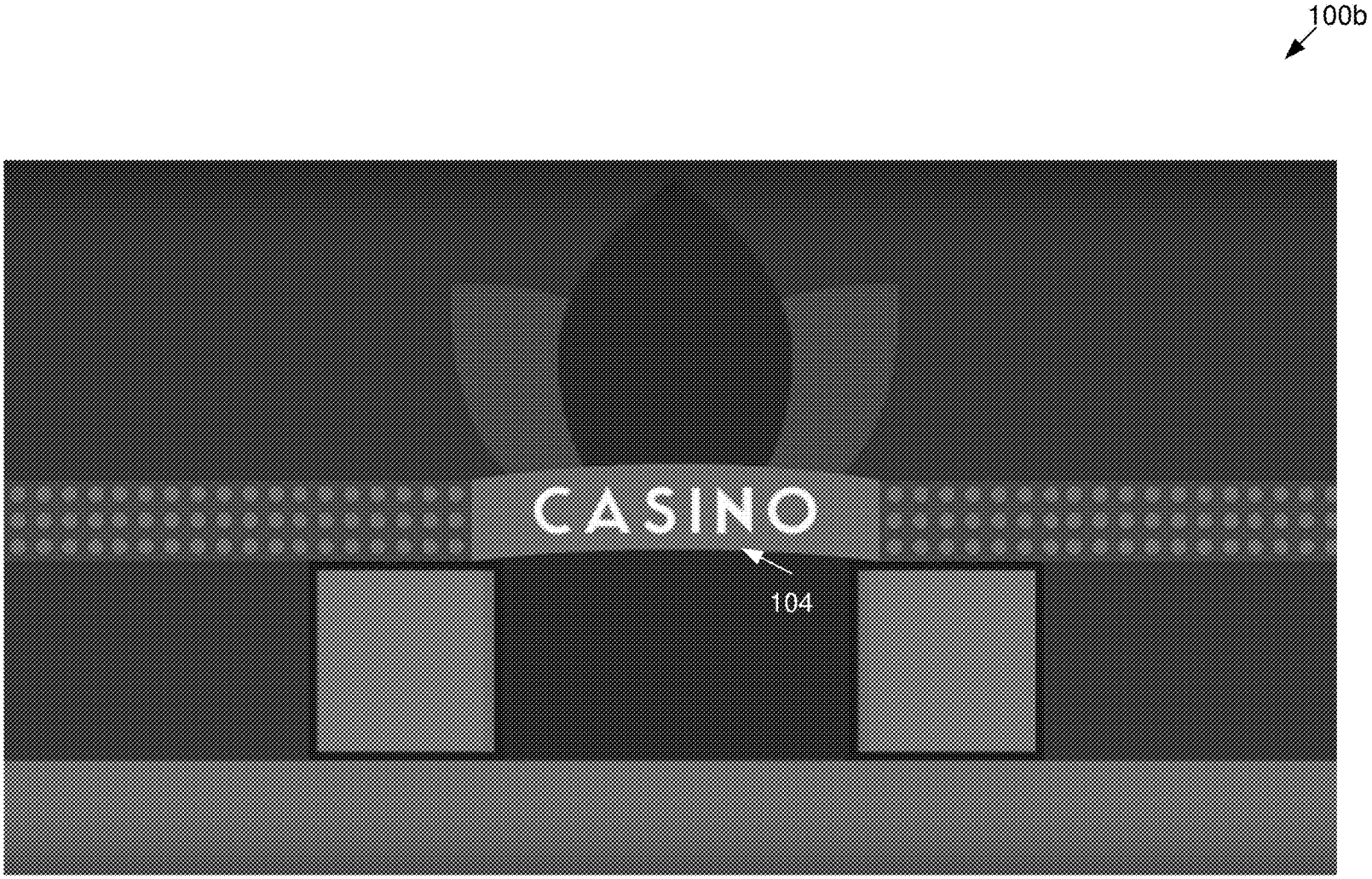
FIG. 1B depicts a diagram of an example of an air curtain control environment.
Figure 1C:
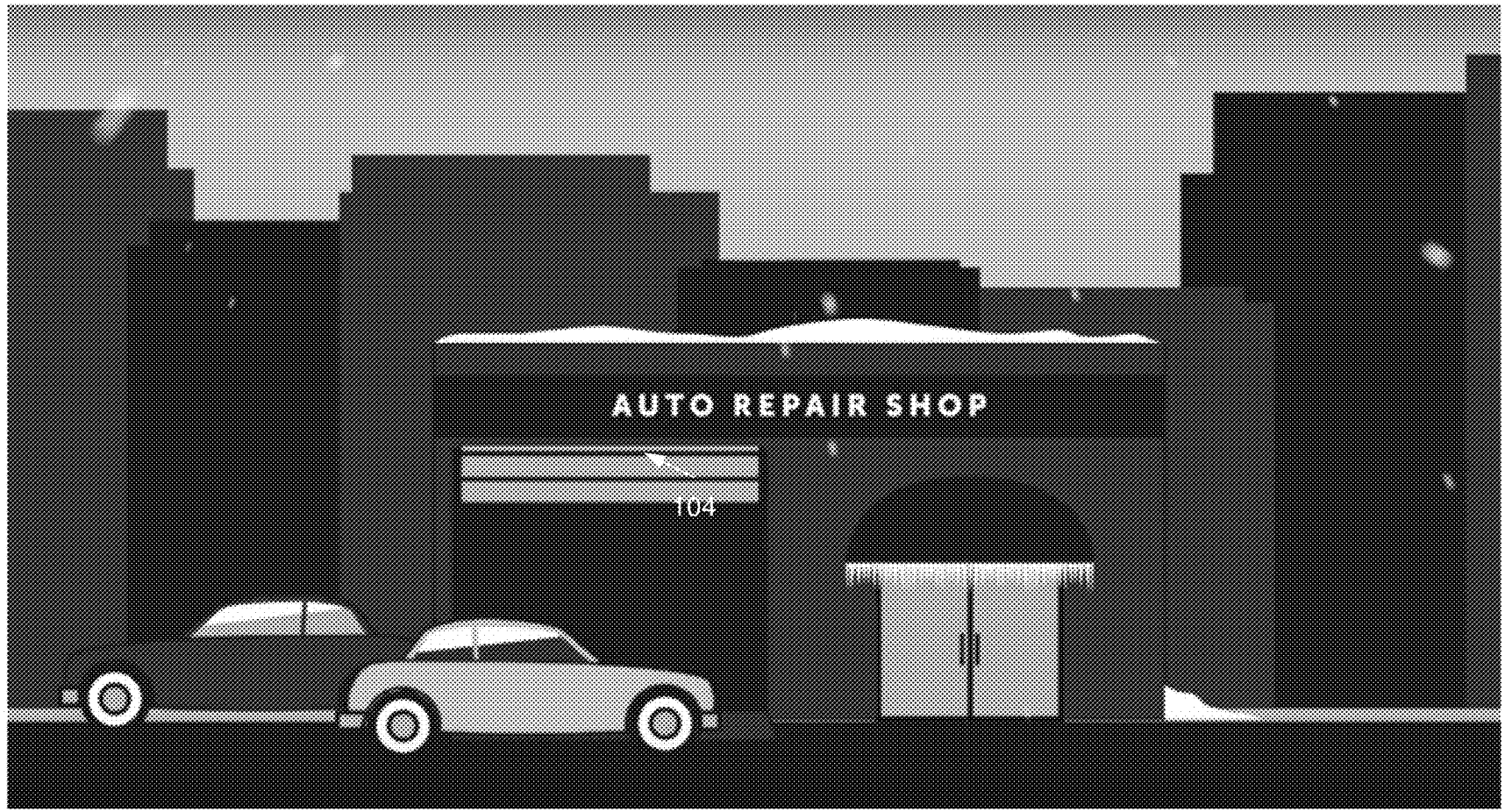
FIG. 1C depicts a diagram of an example of an air curtain control environment.
Figure 1D:
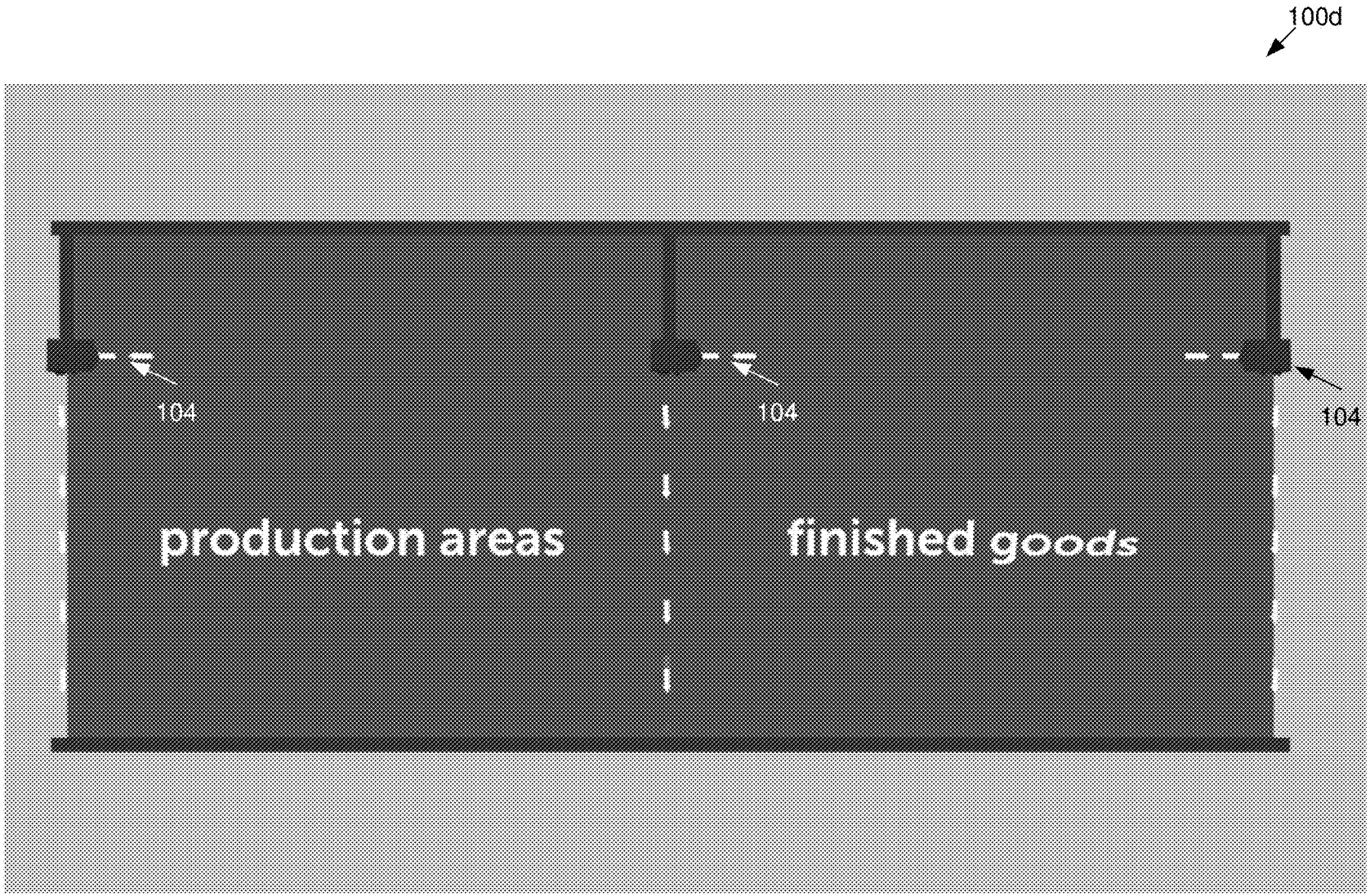
FIG. 1D depicts a diagram of an example of an air curtain control environment.

FIG. 1B depicts a diagram of an example of an air curtain control environment 100B. The air curtain control environment 100B may include a casino into which an air curtain 104 has been inserted to separate an outdoor area and an indoor area. The outdoor area may correspond to the non-controlled environment 120 shown in FIG. 1A, while the indoor area may correspond to the controlled environment 118 shown in FIG. 1A. In various implementations, the air curtain control environment 100B may correspond to an application where the air curtain 104 is configured to allow heating or cooling inside the indoor area to be retained. FIG. 1C depicts a diagram of an example of an air curtain control environment 100C. In this example, the air curtain 104 may be used to retain heat inside a garage. FIG. 1D depicts a diagram of an example of an air curtain control environment 100D. In this example, the air curtains 104 are used to separate production areas from an outdoor environment, and to separate finished goods areas from the production areas. The air curtains 104 may be configured to allow each room to retain air conditioning or heat.

Though FIGS. 1A-1D discuss the systems and methods described herein with reference to the air curtain 104, it is noted that the systems and methods described herein may have equal application to any HVAC system. As an example, the air curtain 104 may be replaced in some implementations with a rooftop AC unit. In accordance with a rooftop AC unit example, the rooftop AC unit may be placed on a roof of a building for which climate control is desired. An area of interest for a rooftop AC unit may comprise an indoor area under the roof (e.g., in the building). A controlled area sensor may be placed inside the building, a non-controlled area sensor may be placed outside the building, and outlet sensors in an area of air outflow from the rooftop AC unit. As another example, the air curtain 104 may be replaced with an exhaust hood. In accordance with an exhaust hood example, the exhaust hood may be placed at a location from which air is to be expelled from one area to another area. An area of interest for the exhaust hood may comprise the area from which air is to be expelled. A controlled area sensor may be placed inside the area of interest to monitor temperature, air circulation, etc., and a non-controlled area sensor may be placed outside the area of interest (e.g., the area where air is expelled to). Outlet sensors may be placed in the area of outflow from the exhaust hood; the outlet sensors may monitor one or more properties of the air outflow. As yet another example, the air curtain 104 may be replaced by a VAV system. In accordance with a VAV system example, the VAV system may be placed near a location that is to be climate controlled using a variable air volume climate control technique. An area of interest may comprise the area that is to be climate controlled. A controlled area sensor within the area of interest may sense temperatures, air flow volumes, air flow speeds, air flow angles, etc. from the VAV system. A non-controlled area sensor outside the area of interest may sense temperatures, air flow volumes, air flow speeds, air flow angles, etc. that is expelled from the area of interest. Outlet sensors may be placed in the area of air outflow from the VAV system.

Figure 2:
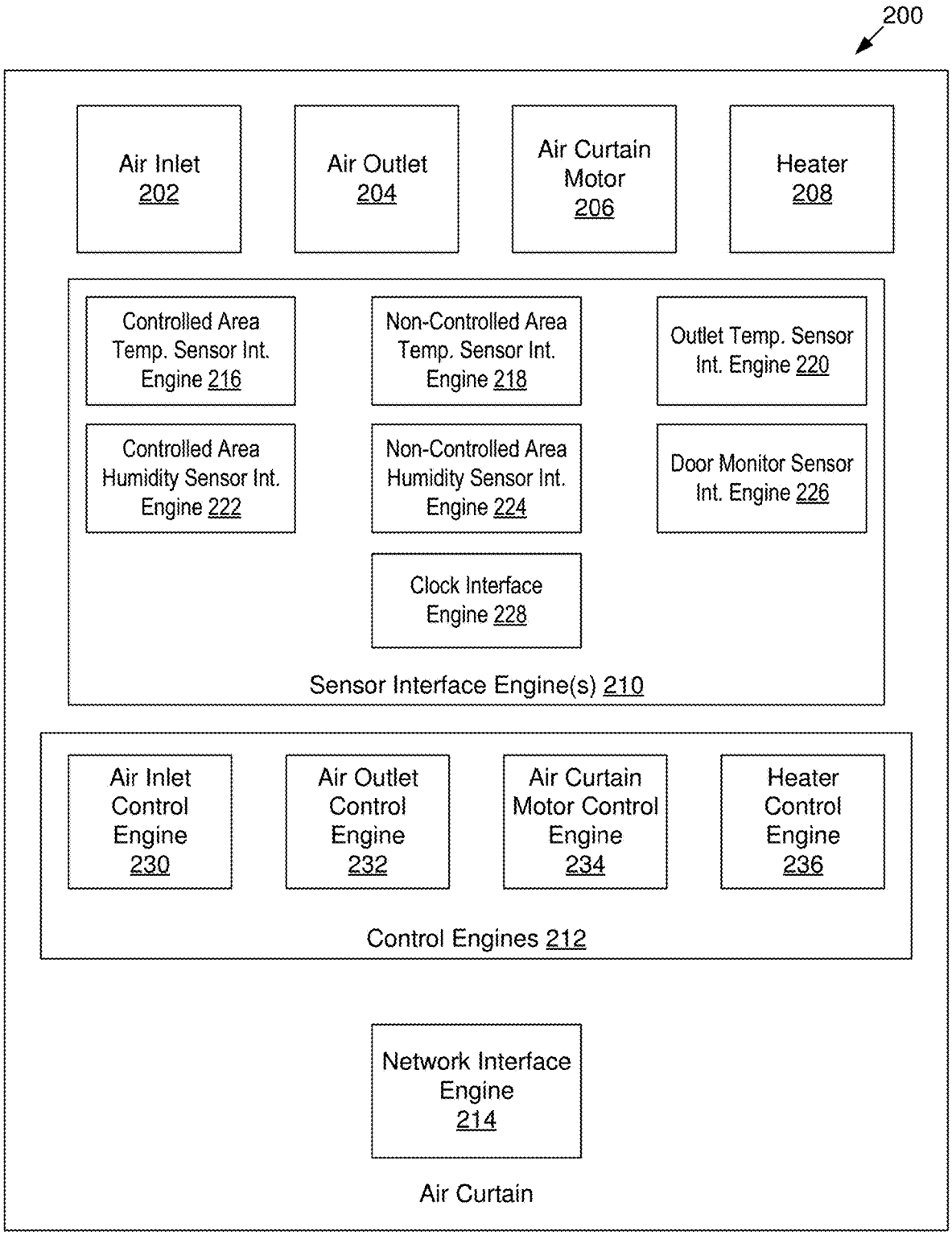
FIG. 2 depicts a diagram of an example of an air curtain.

FIG. 2 depicts a diagram of an example of an air curtain 200. The air curtain 200 may correspond to the air curtain 104, shown in FIGS. 1A-1D and discussed further herein. It is noted that while FIG. 2 depicts an "air curtain 200," as least some of the components of the element 200 may correspond to elements of other HVAC systems, such as rooftop AC units, exhaust hoods, VAV systems, etc. In the example of FIG. 2, the air curtain 200 includes an air inlet 202, an air outlet 204, an air curtain motor 206, a heater 208, sensor interface(s) 210, control engines 212, and a network interface engine 214.

The air inlet 202 may comprise an opening configured to receive air into the air curtain 200 from the environment surrounding the air curtain 200. The air inlet 202 may include air filters, air intake valves, and/or other components that facilitate entry of air into the air curtain 200. In various implementations, the air inlet 202 is coupled to the air curtain motor 206. As noted herein, the air curtain motor 206 may increase air pressure inside it to cause air to enter the air inlet 202 from outside the air curtain 200. The air inlet 202 may be characterized by an air inlet flow that represents (e.g., the velocity, speed, pressure, etc.) air entering thereto. The air inlet 202 may also be characterized by an air inlet angle that represents the direction the air inlet 202 allows air to enter into it. As noted herein, the air inlet 202 may receive instructions from various components (e.g., the air inlet control engine 230) to modify the air inlet flow and/or air inlet angle.

The air outlet 204 may comprise an opening configured to provide air from the air curtain 200 to the environment surrounding the air curtain 200. The air outlet 204 may include air filters, air outlet valves, and/or other components that allow air to be exited from the air curtain 200. In some implementations, the air outlet 204 is coupled to the air curtain motor 206. The air curtain motor 206 may increase air pressure inside the air curtain 200 in order to cause air to exit the air outlet 204. The air outlet 204 may also be coupled to and/or receive heat from the heater 208. In some implementations, the air outlet 204 is characterized by an air outlet flow that represents air exiting therefrom. The air outlet 204 may be characterized by an air outlet angle that represents the direction the air outlet 204 provides air to the environment around the air curtain 200. As discussed further herein, the air outlet 204 may receive instructions from various components (e.g., the air outlet control engine 232) to modify the air outlet flow and/or air outlet angle.

The air curtain motor 206 may comprise a machine configured to cause air to circulate within the air curtain 200. The air curtain motor 206 may comprise a mechanical or other fan that causes air to rotate within the air curtain 200. The air curtain motor 206 may include a housing/case and blades, rotors, impellers, rotors, runners, etc. In some implementations, the air curtain motor 206 is powered by an electric or other (hydraulic, internal combustion, etc.) motor. The air curtain motor 206 may be coupled to the air inlet 202 and cause air to enter the air curtain 200; the air curtain motor 206 may also be coupled to the air outlet 204 and cause air to exit the air curtain 200. The air curtain motor 206 may be characterized by one or motor speeds. Each motor speed may be associated with a velocity of air flow through the air curtain 200. In some implementations, the air curtain motor 206 maintains a predetermined number of discrete motor speeds, each corresponding to a discrete air flow velocity. The air curtain motor 206 may receive instructions from the air curtain motor control engine 234 and/or other engines described herein.

The heater 208 may comprise machinery configured to act as a heat source on behalf of the air curtain 200. The heater 208 may comprise a furnace or other component used to provide heat. The heater 208 may further comprise one or more distribution mechanisms to disperse the heat source to other areas, such as the air outlet 204. The heater 208 may be coupled to the air outlet 204 and the air curtain motor 206. In various implementations, the heater 208 may receive instructions from the heater control engine 236 and/or other components of the air curtain 200.

The sensor interface engine(s) 210 may comprise engines configured to interface with sensors on or near the air curtain 200. More particularly, in various implementations, the sensor interface engine(s) 210 may include engines that receive sensor data from sensors on or near the air curtain 200. The sensor interface engine(s) 210 may further provide instructions to control sensors on or near the air curtain 200. In the example of FIG. 2, the sensor interface engine(s) 210 include a controlled area temperature sensor interface engine 216, a non-controlled area temperature sensor interface engine 218, an outlet temperature sensor interface engine 220, a controlled area humidity sensor interface engine 222, a non-controlled area humidity sensor interface engine 224 a door monitor sensor interface engine 226, and a clock interface engine 228.

The controlled area temperature sensor interface engine 216 may comprise engines configured to receive sensor data from a controlled area temperature sensor that is configured to sense a temperature in a controlled area associated with the air curtain 200. The controlled area temperature sensor interface engine 216 may also provide instructions to control the controlled area temperature sensor. In various implementations, the controlled area temperature sensor interface engine 216 is configured to convert temperature readings taken by a controlled area temperature sensor into a format that can be processed and/or used as the basis of a determination of a measured temperature of a controlled area. The controlled area temperature sensor interface engine 216 may store or otherwise manage sensor data of past/current temperature determinations of the controlled area. In various implementations, the controlled area temperature sensor interface engine 216 may provide the past/current temperature determinations to other modules of the air curtain 200, including but not limited to control engines 212, discussed further herein.

The non-controlled area temperature sensor interface engine 218 may comprise engines configured to receive sensor data from a non-controlled area temperature sensor configured to sense a temperature in a non-controlled area associated with the air curtain 200. The non-controlled area temperature sensor interface engine 218 may also provide instructions to control the non-controlled area temperature sensor. In some implementations, the non-controlled area temperature sensor interface engine 218 is configured to convert temperature readings taken by a non-controlled area temperature sensor into a format that can be processed and/or used as the basis of a determination of a measured temperature of a non-controlled area. The non-controlled area temperature sensor interface engine 218 may store or otherwise manage sensor data of past/current temperature determinations of the non-controlled area. In various implementations, the non-controlled area temperature sensor interface engine 218 may provide the past/current temperature determinations to other modules of the air curtain 200, including but not limited to the control engines 212, discussed further herein.

The outlet temperature sensor interface engine 220 may comprise engines configured to receive sensor data from an outlet temperature sensor that is configured to sense a temperature of the air outlet 204 of the air curtain 200. The outlet temperature sensor interface engine 220 may also provide instructions to control the outlet temperature sensor. In various implementations, the outlet temperature sensor interface engine 220 is configured to convert temperature readings taken by an outlet temperature sensor into a format that can be processed and/or used as the basis of a determination of a measured temperature of air exiting the air outlet 204. The outlet temperature sensor interface engine 220 may store or otherwise manage sensor data of past/current temperature determinations of the air exiting the air outlet 204. In various implementations, the outlet temperature sensor interface engine 220 may provide the past/current temperature determinations to other modules of the air curtain 200, including but not limited to control engines 212, discussed further herein.

The controlled area humidity sensor interface engine 222 may comprise engines configured to receive sensor data from a humidity sensor in a controlled area controlled by the air curtain 200. The controlled area humidity sensor interface engine 222 may also provide instructions to control the humidity sensor in the controlled area. In various implementations, the controlled area humidity sensor interface engine 222 is configured to convert humidity readings taken by a humidity sensor in the controlled area into a format that can be processed and/or used as the basis of a determination of a measured humidity in the controlled area. The controlled area humidity sensor interface engine 222 may store or otherwise manage sensor data of past/current humidity determinations of the controlled area. In various implementations, the controlled area humidity sensor interface engine 222 may provide the past/current humidity determinations to other modules of the air curtain 200, including but not limited to control engines 212, discussed further herein.

The non-controlled area humidity sensor interface engine 224 may comprise engines configured to receive sensor data from a humidity sensor in a non-controlled area associated with the air curtain 200. The non-controlled area humidity sensor interface engine 224 may also provide instructions to control the humidity sensor in the non-controlled area. In various implementations, the non-controlled area humidity sensor interface engine 224 is configured to convert humidity readings taken by a humidity sensor in the non-controlled area into a format that can be processed and/or used as the basis of a determination of a measured humidity in the non-controlled area. The non-controlled area humidity sensor interface engine 224 may store or otherwise manage sensor data of past/current humidity determinations of the non-controlled area. In various implementations, the non-controlled area humidity sensor interface engine 224 may provide the past/current humidity determinations to other modules of the air curtain 200, including but not limited to control engines 212, discussed further herein.

The door monitor sensor interface engine 226 may comprise engines configured to receive sensor data from a door monitor sensor associated with the air curtain 200. The door monitor sensor interface engine 226 may also provide instructions to control the door monitor sensor. The door monitor sensor may comprise any sensor configured to measure opening/closing of a door, revolutions of a revolving door, etc. proximate to the air curtain 200. In various implementations, the door monitor sensor interface engine 226 may receive from a door monitor sensor a number of times a door opens/closes, a rate of ingress/egress of persons through a door, etc. The door monitor sensor interface engine 226 may store or otherwise manage sensor data of past/current door activity (opening/closings/ingress/egress/etc.). In various implementations, the door monitor sensor interface engine 226 may provide the past/current door activity to other modules of the air curtain 200, including but not limited to control engines 212, discussed further herein.

The clock interface engine 228 may comprise engines configured to receive data from a clock associated with the air curtain 200. The clock interface engine 228 may manage or otherwise store past data from clocks.

The control engines 212 may include engines configured to provide instructions to control one or more components of the air curtain 200. The control engines 212 may include an air inlet control engine 230, an air outlet control engine 232, an air curtain motor control engine 234, and a heater control engine 236. The control engines 212, or some part thereof, may, but need not, use an embedded processor on the air curtain 200 to provide the instructions referenced herein. The control engines 212 may receive representations of sensor data from the sensor interface engine(s) 210, as noted further herein.

The air inlet control engine 230 may comprise one or more engines configured to control the air inlet 202. In various implementations, the air inlet control engine 230 provides instructions to the air inlet 202 to modify velocities, angles, pressures, etc. of the air inlet 202. In some implementations, as velocities of the air inlet 202 may be controlled by the air curtain motor 206, the air inlet control engine 230 may cooperate with the air curtain motor control engine 234 to control velocities of the air inlet 202. In some implementations, the air inlet control engine 230 may instruct physical devices that support the air inlet 202 to modify an inlet angle of the air inlet 202.

The air outlet control engine 232 may comprise one or more engines configured to control the air outlet 204. In various implementations, the air outlet control engine 232 provides instructions to the air outlet 204 to modify velocities, angles, pressures, etc. of the air outlet 204. In some implementations, as velocities of the air outlet 204 may be controlled by the air curtain motor 206, the air outlet control engine 232 may cooperate with the air curtain motor control engine 234 to control velocities of the air outlet 204. In various implementations, the air outlet control engine 232 may instruct physical devices that support the air outlet 204 to modify an outlet angle of the air outlet 204.

The air curtain motor control engine 234 may comprise one or more engines configured to control the air curtain motor 206. In various implementations, the air curtain motor control engine 234 provides instructions to the air curtain motor 206 to modify motor speeds, motor direction(s), motor phase(s), motor modes of operation, and/or other properties of the air curtain motor 206. The heater control engine 236 may comprise one or more engines configured to control the heater 208. The heater control engine 236 may provide instructions to the heater 208 to modify amounts of heat applied at a given time and/or in response to a given event.

The network interface engine 214 may comprise one or more engines configured to facilitate a connection to a network. In some implementations, the network interface engine 214 comprises a coupling to any computer-readable medium. The network interface engine 214 may support coupling to a BACnet, wide area network, and/or to any other computer-readable medium.

The air curtain 200 may operate to allow a user to intelligently optimize climate control of a controlled environment as discussed herein. One or more of the sensor interface engine(s) 210 may be configured to receive and/or otherwise process a sensor signal from a temperature, humidity, door monitor and/or other sensor. The sensor signal may contain a representation of a measured environmental factor in a controlled environment, in a non-controlled environment, in an outlet discharge area, etc. associated with the air curtain 200. As an example, the controlled area temperature sensor interface engine 216 may receive/process a sensor signal from a temperature sensor in a controlled area associated with the air curtain 200. The non-controlled area temperature sensor interface engine 218 may receive/process a sensor signal from a temperature sensor in a non-controlled area associated with the air curtain 200. The outlet temperature sensor interface engine 220 may receive/process a sensor signal from a temperature sensor in an outlet discharge area associated with the air curtain 200. The controlled area humidity sensor interface engine 222 may receive/process a sensor signal from a humidity sensor in a controlled area associated with the air curtain 200. The non-controlled area humidity sensor interface engine 224 may receive/process a sensor signal from a humidity sensor in a non-controlled area associated with the air curtain 200. The door monitor sensor interface engine 226 may receive/process a sensor signal from a door monitor configured to monitor a door associated with the air curtain 200. The clock interface engine 228 may receive/process a clock signal from a clock of the air curtain 200.

In various implementations, the sensor interface engine(s) 210 may provide sensor signals to an air curtain control system. The air curtain control system may determine a desired environmental factor of the controlled environment associated with the air curtain 200, and may provide an environmental factor correction for the controlled environment, as noted further herein. The network interface engine 214 may receive information about the environmental factor correction, including specific components of the air curtain 200 that are to implement the environmental factor correction. The network interface engine 214 may provide the information about the environmental factor correction, including the specific components that are to implement the environmental factor correction, to the control engine(s) 212.

The control engine(s) 212 may provide instructions to implement the environmental factor correction. In various implementations, the control engine(s) 212 may identify specific components, such as the air inlet 202, the air outlet 204, the air curtain motor 206, the heater 208, etc. that are to implement the environmental factor correction. The control engine(s) 212 may instruct the specific components to modify various parameters and/or settings in order to implement the environmental factor correction. As an example, the air inlet control engine 230 may instruct the air inlet 202 to modify air speeds, air inlet angles, etc. to implement the environmental factor correction. The air outlet control engine 232 may similarly instruct the air outlet 204 to modify air speeds, air outlet angles, etc. to implement the environmental factor correction. The air curtain motor control engine 234 may instruct the air curtain motor 206 to modify speeds, phases, discrete motor speeds, etc. in order to implement the environmental factor correction. The heater control engine 236 may further instruct the heater 208 to modify various settings to implement the environmental factor correction. It is noted that in various implementations, some combination of the control engine(s) 212 may operate to implement the environmental factor correction.

Figure 3:
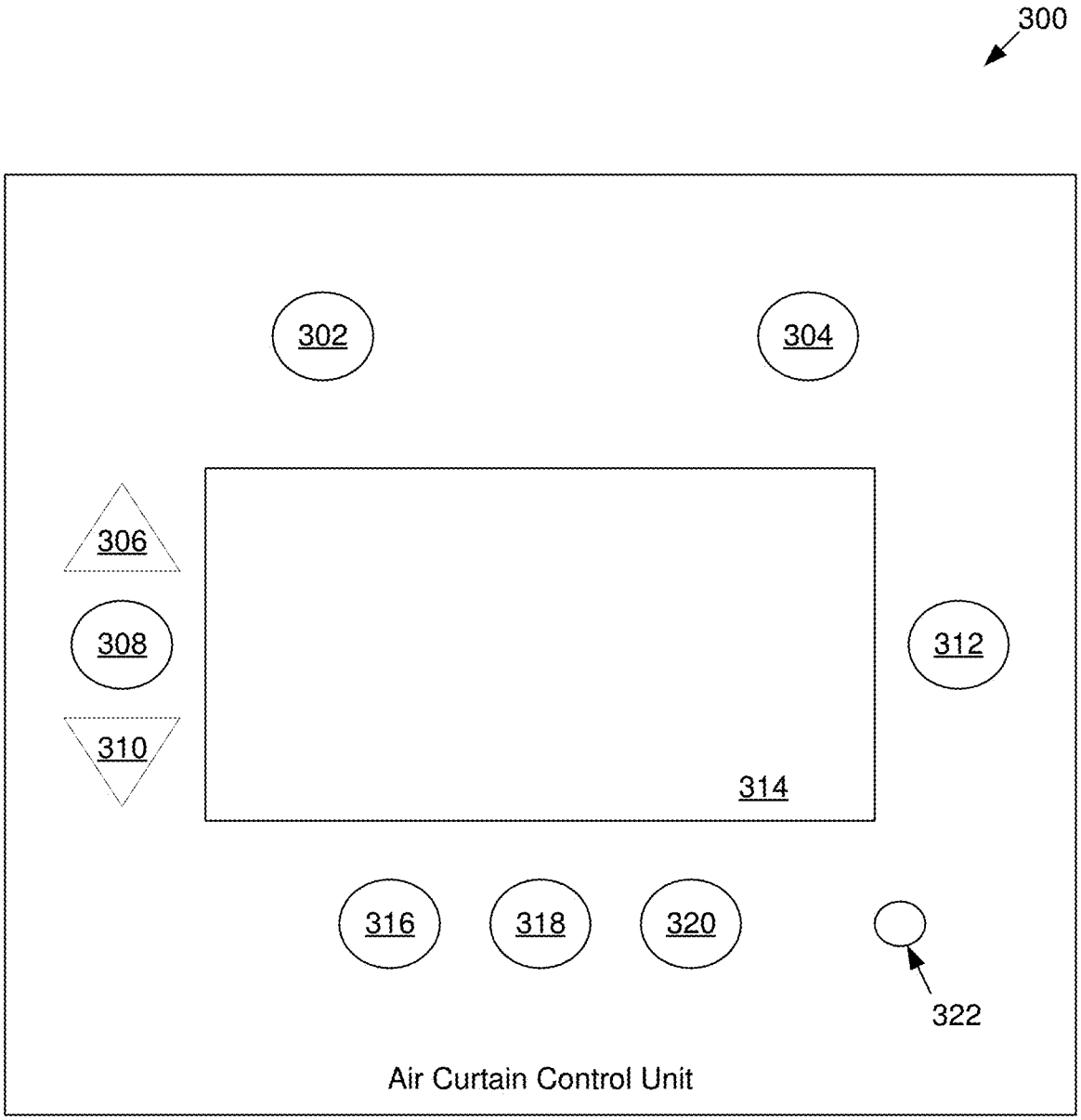
FIG. 3 depicts a diagram of an example of an air curtain control unit.

FIG. 3 depicts a diagram of an example of an air curtain control unit 300. In the example of FIG. 3, the air curtain control unit 300 includes a passcode lock button 302, a heat control button 304, a first settings button 306, a second settings button 308, a third settings button 310, an emergency ON/OFF button 312, a screen 314, a programming button 316, a mode button 318, a service light 320, and a reset button 322.

The passcode lock button 302 may be configured to lock the air curtain control unit 300 from modifying a passcode. Selecting the passcode lock button 302 may allow the air curtain control unit 300 to receive a new password or to prevent future passwords from being entered into the air curtain control unit 300. In various implementations, pushing the passcode lock button 302 may activate a passcode lock. To unlock the device, pressing and holding the passcode lock button 302 for a specified interval of time (e.g., 5 seconds) may display a passcode briefly and then another specified number (e.g., "0000"). The first settings button 306 and the third settings button 310 may be used to change the values of the passcode; upon selection of the second settings button 308 the language, "Passcode Confirmed" or other similar language may be displayed on the screen 314. A normal clock display may be displayed on the screen 314 subsequently.

The heat control button 304 may be configured to receive a selection of a heating setting. The heat control button 304 may be configured to allow users to modify a temperature of a controlled area of an air curtain controlled by the air curtain control unit 300. The heat control button 304 may also be configured to allow a user to turn a fan on or off. In some implementations, the heat control button 304 allows a user to select between three modes of an air curtain: a heating mode, an off mode, and a fan-only mode (in which the air curtain motor runs without heat). In the heating mode, heat may always be on; in the fan-only mode, the air curtain motor may run without heat and will always be on; in the off mode, the air curtain will shut off. In some implementations, the heat control button 304 may be used to turn the air curtain off (e.g., pressing the heat control button 304 for a specified time (e.g., 5 seconds) may turn the air curtain off).

The first settings button 306, the second settings button 308, and the third settings button 310 may be configured to receive modifications to existing settings of an air curtain, including but not limited to settings related to air curtain inlets, air curtain outlets, air curtain motors, and air curtain heaters. In some implementations, the first settings button 306 may be configured as an up button to raise values displayed on the screen 314, the third settings button 310 may be configured as a down button to lower values displayed on the screen 314, and the second settings button 308 may be configured as an ok/accept button to accept values displayed on the screen 314.

The emergency ON/OFF button 312 may allow a user to turn an air curtain on or off. In some implementations, pressing the emergency ON/OFF button 312 may immediately turn the air curtain on or off. Pressing the emergency ON/OFF button 312 may immediately turn off air curtain functionalities, such as air curtain motors and/or air curtain heaters.

The screen 314 may comprise a display for displaying the settings of an air curtain controlled by the air curtain control unit 300. The screen may display air curtain settings, modes, temperatures and/or other environmental factors of a controlled environment, etc. The screen 314 may be used to change settings, etc.

The programming button 316 may comprise a button configured to allow a user to set various settings of the air curtain. The programming button 316 may be configured to allow a user to show/set passcodes, set/change/etc. temperature scales, display troubleshooting options, and display initial settings that may or may not need to be changed. In various implementations, users may use the first settings button 306, the second settings button 308, and the third settings button 310 to modify the settings of the air curtain. The programming button 316 may invoke these settings for the user.

The mode button 318 may be configured to allow a user to select a factory preset air curtain mode of operation for the air curtain. In some implementations, the mode button 318 may be used to select a time delay mode of operation where an air curtain motor and/or heater of the air curtain will run when a door is open and will turn off with time delay when the door closes. The mode button 318 may be used to select a modified time delay mode of operation where an air curtain motor and/or heater of the air curtain will run for a specified time after a door has been opened, and will not run for a specified time after the door has been closed. The mode button 318 may be used to select a comfort mode of operation where an air curtain motor and/or heater of the air curtain will run at full speed when a door is open and will run at a lower speed when the door closes. The mode button 318 may be used to select an automatic ecological mode of operation with time delay where an air curtain motor and/or heater of the air curtain will run only if a door is open during specified times of day, thereby reducing energy usage and/or energy costs. In some implementations, the mode button 318 may be used to select a heat-on-demand mode of operation with time delay where a heater of the air curtain will run if a door is closed and a thermostat calls for heat. The mode button 318 may be used to select a heat-on-demand automatic ecological mode of operation with time delay where a heater of the air curtain will run if a door is closed, a thermostat calls for heat, and the door has been activated during specified times of day. The mode button 318 may be used to select a primary and secondary mode of operation where operation of air curtain motors and/or heaters of primary air curtain(s) is based on operation of an air curtain motor and/or heater of a primary air curtain. The mode button 318 may be used to select custom modes of operation where operation of air curtain motors and/or heaters of the curtain is based on user input and/or user settings. The mode button 318 may be used to select a stack-effect mode of operation where air curtain motors and/or heaters of the air curtain will be configured to compensate for stack effects in a building; these settings may depend on, e.g., ceiling height, shaft effects, number of stories, and wind tunnel effects. In some implementations, choosing a factory preset mode may reset custom features entered with the default values of the mode selected.

The service light 320 may comprise a light (e.g., a Light Emitting Diode (LED), etc.) configured to light up when the air curtain is to be serviced. The reset button 322 may comprise a button that can reset the air curtain control unit 300 and/or an associated air curtain.

In various implementations, the air curtain control unit 300 may operate to receive instructions to modify an air curtain mode of operation of an air curtain. The screen 314 may display one or more settings of an air curtain that are to be modified. The settings may reflect measured environmental factors of a controlled environment of an air curtain that is controlled by the air curtain control unit 300. A user may use the first settings button 306, the second settings button 308, and the third settings button 310 to modify the settings of the air curtain. The user may use the second settings button 308 to select any values of the air curtain and/or air curtain control unit 300. The air curtain control unit 300 may provide instructions to modify air curtain settings over a computer-readable medium to an air curtain control system. The settings may set one or more desired environmental factors of the controlled environment. The settings may form the basis of one or more environmental factor corrections used by the air curtain control system to implement the desired environmental factors.

Figure 4:
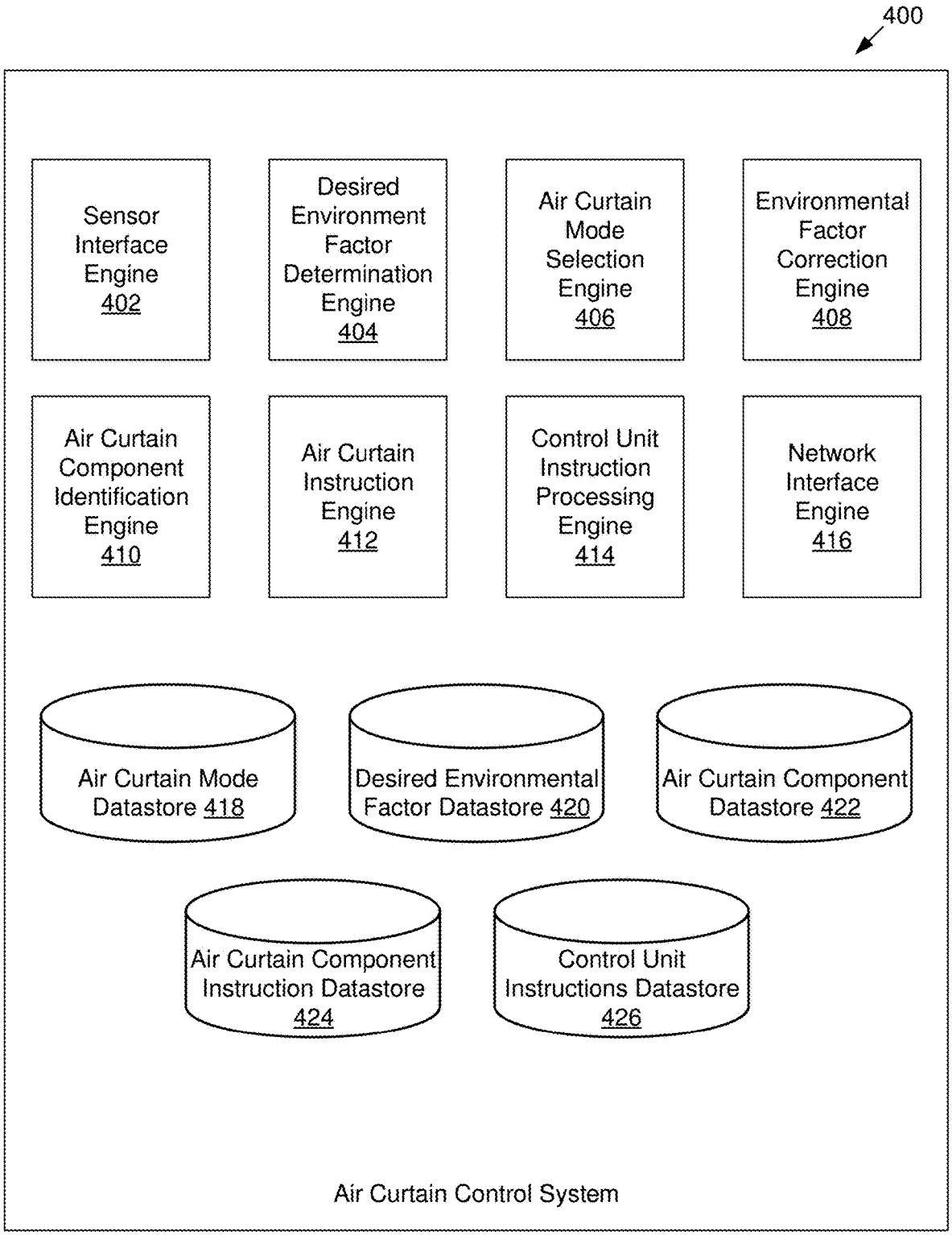
FIG. 4 depicts a diagram of an example of an air curtain control system.

FIG. 4 depicts a diagram of an example of an air curtain control system 400. In the example of FIG. 4, the air curtain control system 400 includes a sensor interface engine 402, a desired environmental factor determination engine 404, an air curtain mode selection engine 406, an environmental factor correction engine 408, an air curtain component identification engine 410, an air curtain instruction engine 412, a control unit instruction processing engine 414, a network interface engine 416, an air curtain mode datastore 418, a desired environmental factor datastore 420, an air curtain component datastore 422, an air curtain component instruction datastore 424, and a control unit instructions datastore 426.

The sensor interface engine 402 may comprise one or more engines configured to interface with sensors associated with one or more air curtains. In some implementations, the sensor interface engine 402 provides instructions to manage one or more of a controlled area temperature sensor, a non-controlled area temperature sensor, an air outlet temperature sensor, a controlled area humidity sensor, a non-controlled area humidity sensor, a door monitor sensor, a clock, etc. The sensor interface engines 402 may provide instructions to the sensors associated with air curtains. The sensor interface engines 402 may be configured receive sensor data from sensors in air curtains. In various implementations, the sensor data may contain representations of temperature(s), humidity(ies), ingress/egress patterns, etc. in a controlled environment around an air curtain, and/or a non-controlled environment around the air curtain. The sensor data may represent measured environmental factors of the controlled environment and/or non-controlled environment related to the air curtain. The sensor interface engine 402 may provide sensor data to other modules of the air curtain control system 400.

The desired environmental factor determination engine 404 may comprise one or more engines configured to determine desired environmental factors associated with an air curtain. In some implementations, the desired environmental factor determination engine 404 may identify one or more desired temperature(s), humidity(ies), ingress/egress patterns, etc. in controlled environment around an air curtain, and/or a non-controlled environment around the air curtain. The desired environmental factor determination engine 404 may gather desired environmental factors from the desired environmental factor datastore 420. In various implementations, the desired environmental factor determination engine 404 may base desired environmental factors on one or more air curtain modes of operation determined by a user of an air curtain control unit.

For a time delay mode of operation, for instance, the desired environmental factor determination engine 404 may identify a trigger condition corresponding to when a door has been opened, and a desired time delay that an air curtain motor and/or a heater in an air curtain are to be delayed after a door has been opened/closed. As another example, for a modified time delay mode of operation, the desired environmental factor determination engine 404 may identify a first trigger corresponding to when a door has been opened, a second trigger corresponding to when a door has been closed, a first time an air curtain motor and/or heater of an air curtain are to run for a specified time after the door has been opened, and a second time the air curtain motor and/or heater of the air curtain are to run after the door has been closed. As yet another example, for a comfort mode of operation, the desired environmental factor determination engine 404 may identify a first trigger condition corresponding to when a door has been opened and a second trigger corresponding to when the door has been closed; for this mode, the desired environmental factor determination engine 404 may further identify a plurality of air curtain motor speeds for an air curtain motor to run, each of the plurality of air curtain motor speeds corresponding to each of the trigger conditions.

For an automatic ecological mode of operation with time delay, for instance, the desired environmental factor determination engine 404 may identify specific times and specific trigger conditions corresponding to whether a door is opened or closed. For this mode, the desired environmental factor determination engine 404 may specify times where an air curtain motor and/or heater are allowed to run if a door has been opened/closed. As another example, for a heat-on-demand mode of operation with time delay, the desired environmental factor determination engine 404 may identify temperatures at which a heater of an air curtain is to run, and a trigger condition corresponding to a closed door. For this mode, the desired environmental factor determination engine 404 may specify temperatures where the heater of the air curtain is to run if a door is closed. As yet another example, for a heat-on-demand automatic ecological mode of operation with time delay, the desired environmental factor determination engine 404 may identify a desired time delay, a first trigger condition corresponding to a door being closed, temperatures at which a heater of an air curtain is to run, and times of day where an air curtain is to run. For this mode, the desired environmental factor determination engine 404 may specify a time and temperature window that the air curtain is to run if a door is opened.

For a primary and secondary mode of operation, the desired environmental factor determination engine 404 may specify primary air curtains and secondary air curtains used for a specific controlled area. As another example, for custom modes of operation, the desired environmental factor determination engine 404 may provide specific combinations of environmental variables that correspond to a specific temperature, time, etc., condition. For a stack-effect mode of operation, as yet another example, the desired environmental factor determination engine 404 may determine the effect of various variables (e.g., ceiling height, shaft effects, number of stories, and wind tunnel effects), on a controlled environment. The desired environmental factor determination engine 404 may provide information about the desired environmental factors to other modules of the air curtain control system 400, including but not limited to the environmental factor correction engine 408.

The air curtain mode selection engine 406 may comprise one or more engines configured to identify one or more air curtain modes of operation. Examples of air curtain modes of operation that may be identified include: a time delay mode of operation, a modified time delay mode of operation, a comfort mode of operation, an automatic ecological mode of operation with time delay, a heat-on-demand mode of operation with time delay, a heat-on-demand automatic ecological mode of operation with time delay, a primary and secondary mode of operation, custom modes of operation, stack-effect modes of operation, etc. The air curtain mode selection engine 406 may receive selection of an air curtain mode of operation from an air curtain control unit. The air curtain mode selection engine 406 may provide selected air curtain modes of operation to other modules of the air curtain control system 400, including but not limited to the desired environmental factor determination engine 404.

The environmental factor correction engine 408 may comprise one or more engines configured to provide an environmental factor correction between a desired environmental factor identified by the desired environmental factor determination engine 404 and a measured environmental factor represented in sensor data by the sensor interface engine 402. In some implementations, the environmental factor correction engine 408 may specify differences of times, temperatures, humidity, door activity, etc. between a desired environmental factor identified by the desired environmental factor determination engine 404 and a measured environmental factor represented in sensor data by the sensor interface engine 402. The environmental factor correction engine 408 may provide other components (e.g., the air curtain component identification engine 410) with the environmental factor correction for the air curtain.

The air curtain component identification engine 410 may comprise one or more engines configured to identify air curtain components used to implement an environmental factor correction. The air curtain component identification engine 410 may identify air inlet(s), air outlet(s), air curtain motor(s), heater(s), etc. on an air curtain or group of air curtains that can operate to implement any specific environmental factor correction. The air curtain instruction engine 412 may include one or more engines configured to instruct identified air curtain components to implement an environmental factor correction. The control unit instruction processing engine 414 may include one or more engines configured to receive and/or otherwise process instructions from an air curtain control unit.

The network interface engine 416 may comprise one or more engines configured to facilitate a connection to a network. In some implementations, the network interface engine 416 comprises a coupling to any computer-readable medium. The network interface engine 416 may support coupling to a BACnet, wide area network, and/or to any other computer-readable medium.

The air curtain mode datastore 418 may comprise one or more datastore configured to store air curtain modes of operation. In some implementations, the air curtain mode datastore 418 stores data related to air inlet settings, air outlet settings, air curtain motor settings, and/or heater settings related to time delay modes of operation, modified and historical time delay modes of operation, comfort modes of operation, automatic ecological modes of operation, heat-on-demand modes of operation, heat-on-demand automatic ecological modes of operation, primary and secondary modes of operation, custom modes of operation, stack-effect modes, etc. The desired environmental factor datastore 420 may comprise one or more datastore configured to store air inlet settings, air outlet settings, air curtain motor settings, and/or heater settings related to desired environmental factors of a controlled environment associated with an air curtain. The air curtain component datastore 422 may comprise data related to air curtain components that can be controlled by the air curtain control system 400. The air curtain component instruction datastore 424 may comprise one or more datastore configured to store information related to air curtain components. The control unit instructions datastore 426 may be configured to store instructions to control an air curtain control unit 300.

In various implementations, the air curtain control system 400 may operate to control an air curtain in an intelligent, efficient, and/or cost-effective manner. The sensor interface engine 402 may operate to process one or more sensor signals that contain a representation of a measured environmental factor in an environment proximate to an air curtain. More particularly, the sensor interface engine 402 may operate to In some implementations, the sensor interface engine 402 provides instructions to manage one or more of a controlled area temperature sensor, a non-controlled area temperature sensor, an air outlet temperature sensor, a controlled area humidity sensor, a non-controlled area humidity sensor, a door monitor sensor, a clock, etc. The sensor interface engines 402 may provide instructions to the sensors associated with air curtains. The sensor interface engines 402 may be configured receive sensor data from sensors in air curtains. In various implementations, the sensor data may contain representations of temperature(s), humidity(ies), ingress/egress patterns, etc. in a controlled environment around an air curtain, and/or a non-controlled environment around the air curtain. The sensor data may represent measured environmental factors of the controlled environment and/or non-controlled environment related to the air curtain. The sensor interface engine 402 may provide sensor data to other modules of the air curtain control system 400. In various implementations, the sensor interface engine 402 provides sensor data to the environmental factor correction engine 408.

The air curtain mode selection engine 406 may operate to select an air curtain mode of operation. In various implementations, the air curtain mode selection engine 406 receives from an air curtain control unit an air curtain mode of operation that a user has selected for an air curtain. Examples of air curtain modes of operation that may be identified include: a historical time delay mode of operation, a modified time delay mode of operation, a comfort mode of operation, an automatic ecological mode of operation with time delay, a heat-on-demand mode of operation with time delay, a heat-on-demand automatic ecological mode of operation with time delay, a primary and secondary mode of operation, custom modes of operation, stack-effect modes of operation, etc. The air curtain mode selection engine 406 may provide the air curtain mode of operation to other modules of the air curtain control system 400. The air curtain mode selection engine 406 may provide the air curtain mode of operation to the desired environmental factor determination engine 404.

The desired environmental factor determination engine 404 may determine one or more desired environmental factors for a controlled environment being controlled by an air curtain. The desired environmental factors may comprise any combination of temperature, humidity, time delays, door triggers, etc. In various implementations, the desired environmental factors are based at least in part on an air curtain mode of operation selected by the air curtain mode selection engine 406. The desired environmental factor determination engine 404 may provide desired environmental factors to one or more other modules of the air curtain control system 400. In various implementations, the desired environmental factor determination engine 404 provides desired environmental factors for a controlled environment of an air curtain to the environmental factor correction engine 408.

The environmental factor correction engine 408 may operate to identify environmental factor correction(s) for the controlled environment of the air curtain. The environmental factor correction may comprise a deviation of a measured historical environmental factor (e.g., an environmental factor measured by sensor data) and a desired environmental factor. The environmental factor correction engine 408 may provide the environmental factor(s) to the other modules of the air curtain control system 400, such as the air curtain component identification engine 410.

The air curtain component identification engine 410 may operate to identify an air curtain component (air inlet, air outlet, air curtain motor, heater, etc.) of an air curtain that can implement the environmental factor correction. As an example, the air curtain component identification engine 410 may operate to identify whether air speed/angles of an air inlet or an air outlet would affect the environmental factor correction. As another example, the air curtain component identification engine 410 may identify whether or not modifying settings of an air curtain motor (e.g., turning it on/off, modifying its speed, etc.) would affect the environmental factor correction. The air curtain component identification engine 410 may also identify whether or not changing a setting of a heater of an air curtain would affect the environmental factor correction. The air curtain component identification engine 410 may provide identifiers of any identified air curtain components to the air curtain instruction engine 412. The air curtain instruction engine 412 may operate to provide instructions to identified components of an air curtain to implement an environmental factor correction. The air curtain instruction engine 412 may provide instructions to the air curtain through the network interface engine 416 or other module.

Figure 5:
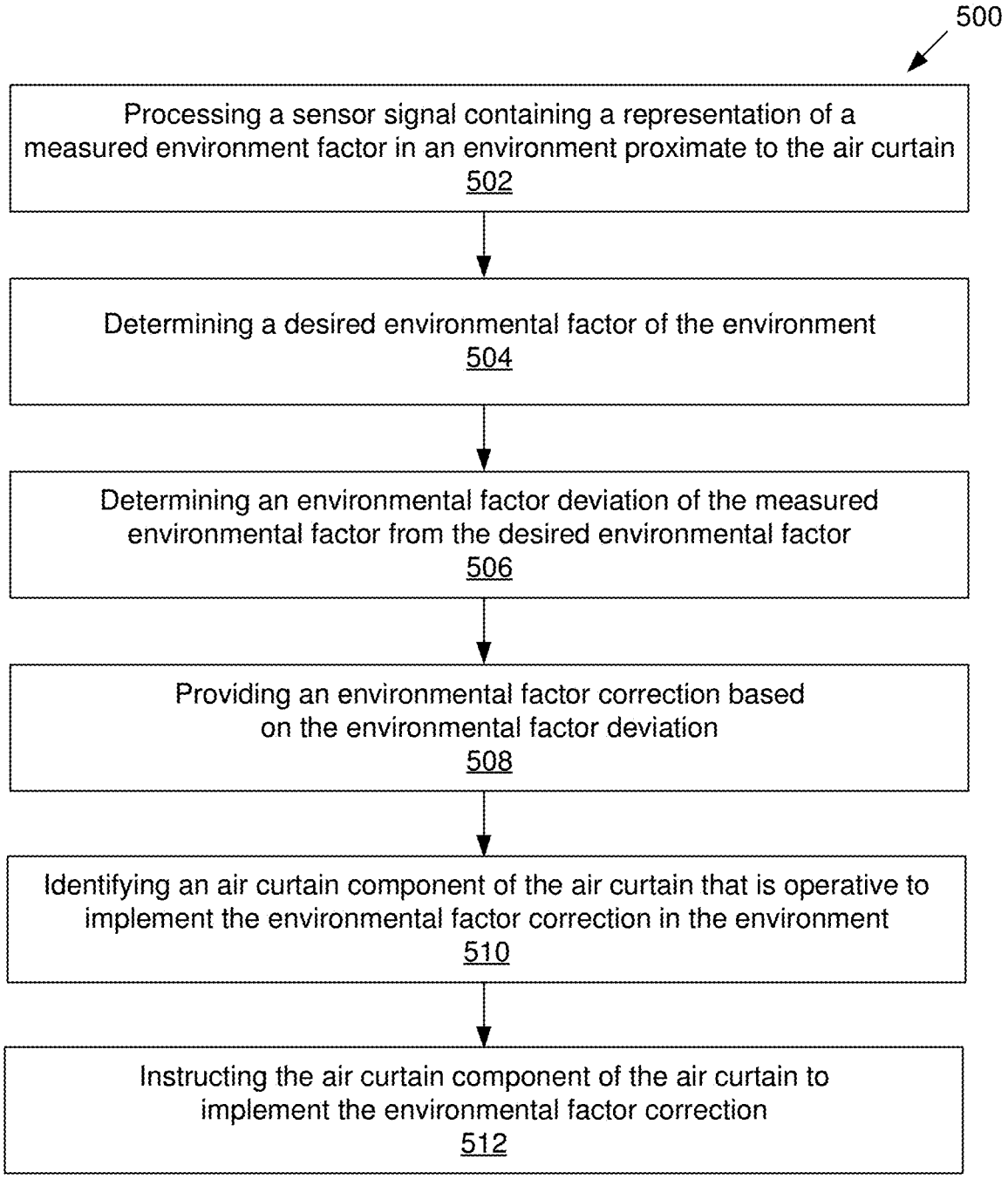
FIG. 5 depicts a flowchart of an example of a method for instructing an air curtain component of an air curtain to implement an environmental factor correction.

FIG. 5 depicts a flowchart 500 of an example of a method for instructing an air curtain component of an air curtain to implement an environmental factor correction. The flowchart 500 is discussed in conjunction with the structures of the air curtain control system 400 shown in FIG. 4 and discussed further herein. It is noted the flowchart 500 may have a greater number or a fewer number of operations than those explicitly shown in FIG. 5. It is further noted the flowchart 500 may be implemented by structures other than the structures shown in FIG. 4.

At an operation 502, a sensor signal containing a representation of a measured environmental factor in an environment proximate to an air curtain may be processed. In some implementations, the sensor interface engine 402 may gather sensor signals that represent therein a measured environmental factor (temperature, humidity, time delay associated with air curtain running or being off, door activity, ingress/egress from controlled area, etc.). The sensor interface engine 402 may provide the sensor signals and/or a representation of the measured environmental factor to the environmental factor correction engine 408.

At an operation 504, a desired environmental factor of the environment may be determined. In various implementations, the desired environmental factor determination engine 404 may determine a desired environmental factor of a controlled area associated with an air curtain. The desired environmental factor may comprise temperature, humidity, motion, pressure, opacity, time delay associated with air curtain running or being off, door activity, ingress/egress from controlled area, etc. The desired environmental factor may depend on an air curtain mode of operation.

At an operation 506, an environmental factor deviation of the measured environmental factor from the desired environmental factor may be determined. In some implementations, the environmental factor correction engine 408 may identify the extent the desired environmental factor deviates from the measured environmental factor. At an operation 508, an environmental factor correction based on the environmental factor deviation may be provided. More particularly, environmental factor correction engine 408 may provide an environmental factor correction to the air curtain component identification engine 410.

At an operation 510, an air curtain component of the air curtain that is operative to implement the environmental factor correction in the environment may be identified. The air curtain component identification engine 410 may identify, e.g., whether an air curtain inlet, an air curtain outlet, an air curtain motor, an air curtain heater, etc. can operate to implement the environmental factor correction. At an operation 512, the air curtain component of the air curtain may be instructed to implement the environmental factor correction. The air curtain instruction engine 412 may instruct the air curtain, e.g., over the network interface engine 416, to implement the environmental factor correction.

Figure 6:
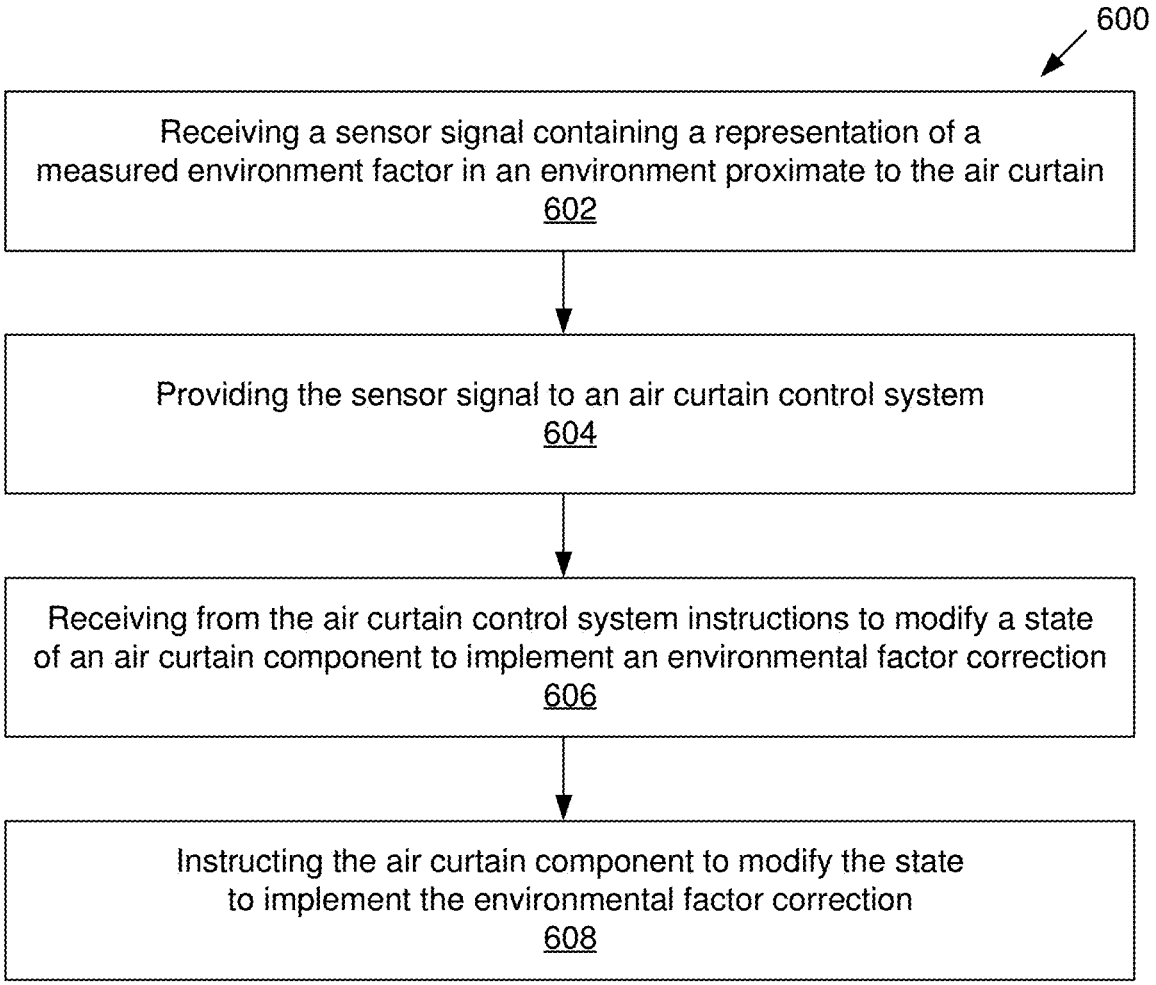
FIG. 6 depicts a flowchart of an example of a method for capturing and processing environmental factor data.

FIG. 6 depicts a flowchart 600 of an example of a method 600 for capturing and processing environmental factor data. The flowchart 600 is discussed in conjunction with the structures of the air curtain 200 shown in FIG. 2 and discussed further herein. It is noted the flowchart 600 may have a greater number or a fewer number of operations than those explicitly shown in FIG. 6. It is further noted the flowchart 600 may be implemented by structures other than the structures shown in FIG. 2.

At an operation 602, a sensor signal containing a representation of a measured environmental factor in an environment proximate to the air curtain may be received. In some implementations, one or more of the sensor interface engine(s) 210 may process sensor signals that contain a representation of a measured environmental factor near the air curtain 200. The controlled area temperature sensor interface engine 216 may, for instance, process a sensor signal that contains a representation of a temperature of a controlled area near the air curtain 200. The non-controlled area temperature sensor interface engine 218 may process a sensor signal that contains a representation of a temperature of a non-controlled area near the air curtain 200. The outlet temperature sensor interface engine 220 may process a sensor signal that contains a representation of a temperature of an air outflow of the air curtain 200. The controlled area humidity sensor interface engine 222 may process a sensor signal that contains a representation of a humidity of a controlled area near the air curtain 200. The non-controlled area humidity sensor interface engine 224 may process a sensor signal that contains a representation of a humidity of a non-controlled area near the air curtain 200. The clock interface engine 228 may process a sensor signal that contains a representation of timing of activity of the air curtain 200. The door monitor sensor interface engine 226 may process a sensor signal that contains a representation of door activity of a door near the air curtain 200.

At an operation 604, the sensor signal may be provided to an air curtain control system. In some implementations, the sensor interface engine(s) 210 may provide the sensor signals to the network interface engine 214, which in turn may provide the sensor signal to an air curtain control system.

At an operation 606, instructions to modify a state of an air curtain component to implement an environmental factor correction may be received from the air curtain control system. The network interface engine 214 may receive instructions to modify a state of one or more of the air inlet 202, the air outlet 204, the air curtain motor 206, and the heater 208. The instructions may include modifications to speeds, angles, on/off settings, and/or power settings of any of these components. The network interface engine 214 may provide the instructions to modify the state of the air curtain components to the control engines 212.

At an operation 608, the air curtain component may be instructed to modify the state to implement the environmental factor correction. In various implementations, the control engines 212 may provide instructions to modify state(s) of the identified air curtain components. As an example, the air inlet control engine 230 may provide instructions to modify a state of the air inlet 202 by modifying air inlet speeds, air inlet angles, etc. The air outlet control engine 232 may provide instructions to modify a state of the air outlet 204 by modifying air outlet speeds, air outlet angles, etc. The air curtain motor control engine 234 may provide instructions to modify state(s) of the air curtain motor 206. The heater control engine 236 may provide instructions to modify a state (on/off states, power levels, etc.) of the heater 208.

Figure 7:
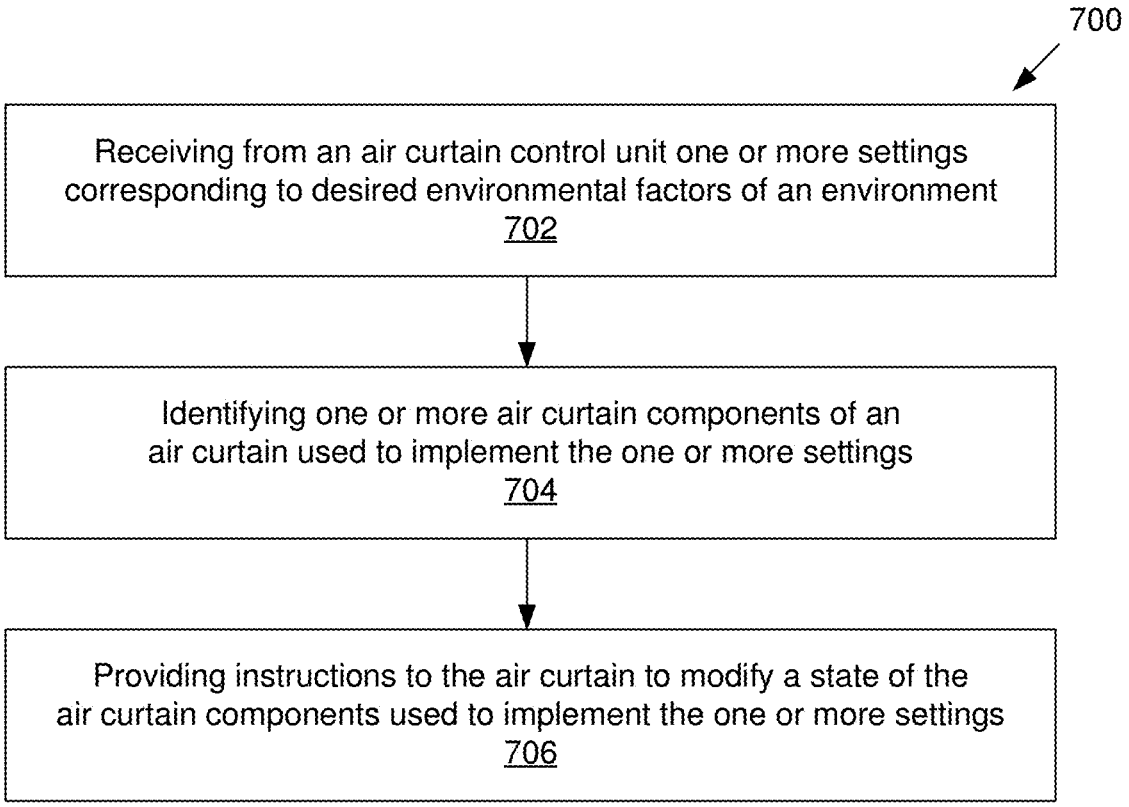
FIG. 7 depicts a flowchart of an example of a method for setting desired environmental factors for an air curtain.

FIG. 7 depicts a flowchart of an example of a method 700 for setting desired environmental factors for an air curtain. The flowchart 700 is discussed in conjunction with the structures of the air curtain control unit 300 shown in FIG. 3 and discussed further herein. It is noted the flowchart 700 may have a greater number or a fewer number of operations than those explicitly shown in FIG. 7. It is further noted the flowchart 600 may be implemented by structures other than the structures shown in FIG. 3.

At an operation 702, one or more settings corresponding to desired environmental factors of an environment may be received from an air curtain control unit. In some implementations, the first settings button 306, the second settings button 308, and/or the third settings button 310 may be configured to receive settings corresponding to a desired environmental factors of an environment near an air curtain. At an operation 704, one or more air curtain components of an air curtain used to implement the one or more settings may be identified. At an operation 706, instructions may be provided to the air curtain to modify a state of the air curtain components used to implement the one or more settings.

Figure 8:
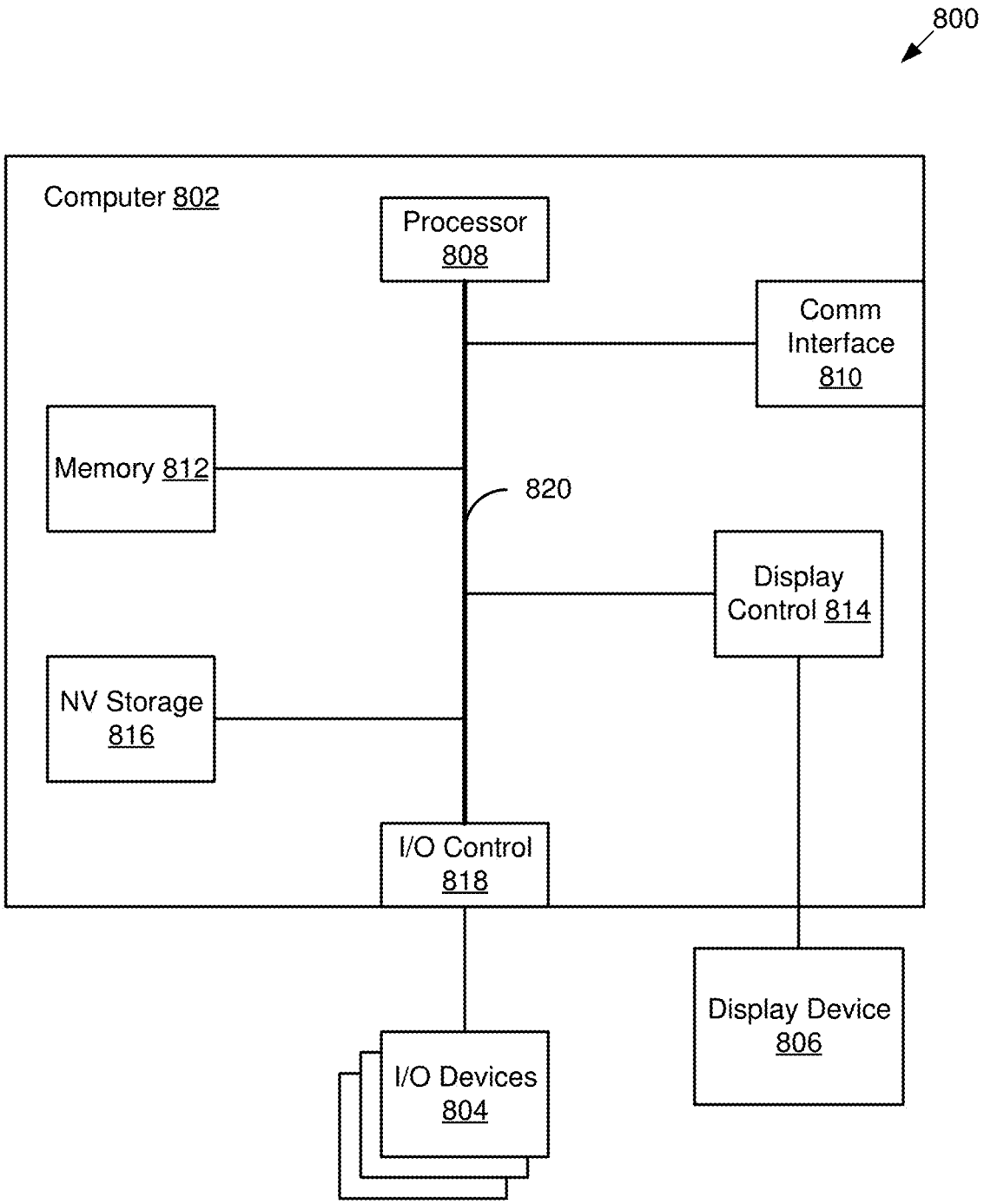
FIG. 8 depicts a diagram of an example of a computer system.

FIG. 8 shows a computer system 800, according to some embodiments. The computer system 800 may be a conventional computer system that may be used as a client computer system, such as a wireless client or a workstation, or a server computer system. The computer system 800 includes a computer 802, I/O devices 812, and a display device 806. The computer 802 includes a processor 808, a communications interface 810, memory 812, display controller 814, non-volatile storage 816, and I/O controller 818. The computer 802 may be coupled to or include the I/O devices 812 and display device 806.

The computer 802 interfaces to external systems through the communications interface 810, which may include a modem or network interface. It will be appreciated that the communications interface 810 may be considered to be part of the computer system 800 or a part of the computer 802. The communications interface 810 may be an analog modem, ISDN modem, cable modem, token ring interface, satellite transmission interface (e.g. "direct PC"), or other interfaces for coupling a computer system to other computer systems.

The processor 808 may be, for example, a conventional microprocessor such as an Intel Pentium microprocessor or Motorola power PC microprocessor. The memory 812 is coupled to the processor 808 by a bus 820. The memory 812 may be Dynamic Random Access Memory (DRAM) and may also include Static RAM (SRAM). The bus 820 couples the processor 808 to the memory 812, also to the non-volatile storage 816, to the display controller 814, and to the I/O controller 818.

The I/O devices 812 may include a keyboard, disk drives, printers, a scanner, and other input and output devices, including a mouse or other pointing device. The display controller 814 may control in the conventional manner a display on the display device 806, which may be, for example, a cathode ray tube (CRT) or liquid crystal display (LCD). The display controller 814 and the I/O controller 818 may be implemented with conventional well-known technology.

The non-volatile storage 816 is often a magnetic hard disk, an optical disk, or another form of storage for large amounts of data. Some of this data is often written, by a direct memory access process, into memory 812 during execution of software in the computer 802. One of skill in the art will immediately recognize that the terms "machine-readable medium" or "computer-readable medium" includes any type of storage device that is accessible by the processor 808 and also encompasses a carrier wave that encodes a data signal.

The computer system 800 is one example of many possible computer systems that have different architectures. For example, personal computers based on an Intel microprocessor often have multiple buses, one of which may be an I/O bus for the peripherals and one that directly connects the processor 808 and the memory 812 (often referred to as a memory bus). The buses are connected together through bridge components that perform any necessary translation due to differing bus protocols.

Network computers are another type of computer system that may be used in conjunction with the teachings provided herein. Network computers do not usually include a hard disk or other mass storage, and the executable programs are loaded from a network connection into the memory 812 for execution by the processor 808. A Web TV system, which is known in the art, is also considered to be a computer system, but it may lack some of the features shown in FIG. 8, such as certain input or output devices. A typical computer system will usually include at least a processor, memory, and a bus coupling the memory to the processor.

Though FIG. 8 shows an example of the computer system 800, it is noted that the term "computer system," as used in this paper, is intended to be construed broadly. In general, a computer system will include a processor, memory, non-volatile storage, and an interface. A typical computer system will usually include at least a processor, memory, and a device (e.g., a bus) coupling the memory to the processor. The processor may be, for example, a general-purpose central processing unit (CPU), such as a microprocessor, or a special-purpose processor, such as a microcontroller.

The memory may include, by way of example but not limitation, random access memory (RAM), such as dynamic RAM (DRAM) and static RAM (SRAM). The memory may be local, remote, or distributed. As used in this paper, the term "computer-readable storage medium" is intended to include only physical media, such as memory. As used in this paper, a computer-readable medium is intended to include all mediums that are statutory (e.g., in the United States, under 35 U.S.C. 101), and to specifically exclude all mediums that are non-statutory in nature to the extent that the exclusion is necessary for a claim that includes the computer-readable medium to be valid. Known statutory computer-readable mediums include hardware (e.g., registers, random access memory (RAM), non-volatile (NV) storage, to name a few), but may or may not be limited to hardware.

The bus may also couple the processor to the non-volatile storage. The non-volatile storage is often a magnetic floppy or hard disk, a magnetic-optical disk, an optical disk, a read-only memory (ROM), such as a CD-ROM, EPROM, or EEPROM, a magnetic or optical card, or another form of storage for large amounts of data. Some of this data is often written, by a direct memory access process, into memory during execution of software on the computer system. The non-volatile storage may be local, remote, or distributed. The non-volatile storage is optional because systems may be created with all applicable data available in memory.

Software is typically stored in the non-volatile storage. Indeed, for large programs, it may not even be possible to store the entire program in the memory. Nevertheless, it should be understood that for software to run, if necessary, it is moved to a computer-readable location appropriate for processing, and for illustrative purposes, that location is referred to as the memory in this paper. Even when software is moved to the memory for execution, the processor will typically make use of hardware registers to store values associated with the software, and local cache that, ideally, serves to speed up execution. As used in this paper, a software program is assumed to be stored at an applicable known or convenient location (from non-volatile storage to hardware registers) when the software program is referred to as "implemented in a computer-readable storage medium." A processor is considered to be "configured to execute a program" when at least one value associated with the program is stored in a register readable by the processor.

In one example of operation, the computer system 800 may be controlled by operating system software, which is a software program that includes a file management system, such as a disk operating system. One example of operating system software with associated file management system software is the family of operating systems known as Windows® from Microsoft Corporation of Redmond, Wash., and their associated file management systems. Another example of operating system software with its associated file management system software is the Linux operating system and its associated file management system. The file management system is typically stored in the non-volatile storage and causes the processor to execute the various acts required by the operating system to input and output data and to store data in the memory, including storing files on the non-volatile storage.

The bus 820 may also couple the processor 808 to the communications interface 810. The communications interface 810 may include one or more input and/or output (I/O) devices. The I/O devices may include, by way of example but not limitation, a keyboard, a mouse or other pointing device, disk drives, printers, a scanner, and other I/O devices, including a display device. The display device 806 may include, by way of example but not limitation, a cathode ray tube (CRT), liquid crystal display (LCD), or some other applicable known or convenient display device. The communications interface 810 may include one or more of a modem or network interface. It will be appreciated that a modem or network interface may be considered to be part of the computer system 800. The communications interface 810 may include an analog modem, ISDN modem, cable modem, token ring interface, satellite transmission interface (e.g. "direct PC"), or other interfaces for coupling the computer system 800 to other computer systems. The communications interfaces 810 may enable computer systems and other devices to be coupled together in a network.

Several components described in this paper, including clients, servers, and engines, may be compatible with or implemented using a cloud-based computing system. As used in this paper, a cloud-based computing system is a system that provides computing resources, software, and/or information to client devices by maintaining centralized services and resources that the client devices may access over a communication interface, such as a network. The cloud-based computing system may involve a subscription for services or use a utility pricing model. Users may access the protocols of the cloud-based computing system through a web browser or other container application located on their client device.

This paper describes techniques that those of skill in the art may implement in numerous ways. For instance, those of skill in the art may implement the techniques described in this paper using a process, an apparatus, a system, a composition of matter, a computer program product embodied on a computer-readable storage medium, and/or a processor, such as a processor configured to execute instructions stored on and/or provided by a memory coupled to the processor. Unless stated otherwise, a component such as a processor or a memory described as being configured to perform a task may be implemented as a general component that is configured to perform the task at a given time or a specific component that is manufactured to perform the task. As used in this paper, the term 'processor' refers to one or more devices, circuits, and/or processing cores configured to process data, such as computer program instructions.

A detailed description of one or more implementations of the invention is provided in this paper along with accompanying figures that illustrate the principles of the invention. The invention is described in connection with such implementations, but the invention is not limited to any implementation. The scope of the invention is limited only by the claims and the invention encompasses numerous alternatives, modifications and equivalents. Numerous specific details are set forth in the following description in order to provide a thorough understanding of the invention. These details are provided for the purpose of example and the invention may be practiced according to the claims without some or all of these specific details. For the purpose of clarity, technical material that is known in the technical fields related to the invention has not been described in detail so that the invention is not unnecessarily obscured.

Some portions of the detailed description are presented in terms of algorithms and symbolic representations of operations on data bits within a computer memory. These algorithmic descriptions and representations are the means used by those skilled in the data processing arts to most effectively convey the substance of their work to others skilled in the art. An algorithm is here, and generally, conceived to be a self-consistent sequence of operations leading to a desired result. The operations are those requiring physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers, or the like.

It should be borne in mind, however, that all of these and similar terms are to be associated with the appropriate physical quantities and are merely convenient labels applied to these quantities. Unless specifically stated otherwise as apparent from the following discussion, it is appreciated that throughout the description, discussions utilizing terms such as "processing" or "computing" or "calculating" or "determining" or "displaying" or the like, refer to the action and processes of a computer system, or similar electronic computing device, that manipulates and transforms data represented as physical (electronic) quantities within the computer system's registers and memories into other data similarly represented as physical quantities within the computer system memories or registers or other such information storage, transmission or display devices.

Techniques described in this paper relate to apparatus for performing the operations. The apparatus may be specially constructed for the required purposes, or it may comprise a general-purpose computer selectively activated or reconfigured by a computer program stored in the computer. Such a computer program may be stored in a computer-readable storage medium, such as, but is not limited to, read-only memories (ROMs), random access memories (RAMs), EPROMs, EEPROMs, magnetic or optical cards, any type of disk including floppy disks, optical disks, CD-ROMs, and magnetic-optical disks, or any type of media suitable for storing electronic instructions, and each coupled to a computer system bus. Although the foregoing implementations have been described in some detail for purposes of clarity of understanding, implementations are not necessarily limited to the details provided.

What is claimed is:

1. An air curtain control system for controlling an air curtain for a door of a building, the air curtain control system comprising:

a sensor interface engine configured to receive one or more sensor signals, each of the one or more sensor signals containing a representation of a measured environmental factor, a first particular sensor signal of the one or more sensor signals containing a first particular representation of a first particular measured environmental factor of an air outflow in an environment proximate to the air curtain, the air outflow being discharged from the air curtain orthogonal to an ordinary airflow that flows between a controlled area and an uncontrolled area divided by a door of a building, the environment proximate to the air curtain being a part of the controlled area, the air outflow creating a barrier of air capable of preventing movement of one or more entities between the controlled area and the uncontrolled area, a second particular sensor signal of the one or more sensor signals containing a second particular representation of a second particular measured environmental factor, the second particular measured environmental factor including a door open or closed condition of the door;

a database storing the door open or closed condition, including past door open or closed conditions;

an air curtain control unit configured to receive selection of a particular operation mode of a plurality of operation modes, the plurality of operation modes including at least two different operation modes for controlling the air curtain, at least one of the two different operation modes being based on dependent factors including the measured environmental factor, the door open or closed condition, at least one of the past door open or closed conditions, and one or more structural factors of the building;

a desired environmental factor determination engine configured to determine a desired environmental factor of the environment, the desired environmental factor being determined based on the selected particular operation mode;

an environmental factor correction engine configured to determine an environmental factor deviation of the measured environmental factor from the desired environmental factor, and to provide an environmental factor correction based on the environmental factor deviation and on the selected particular operation mode;

an air curtain component identification engine configured to identify one or more air curtain components of the air curtain that are operative to assist in implementing the environmental factor correction; and an air curtain instruction engine configured to instruct the one or more air curtain components of the air curtain to adjust one or more component settings in order to assist in implementing the environmental factor correction.

2. The air curtain control system of claim 1, wherein the one or more air curtain components comprise one or more of a heater, an air curtain motor, an air intake, and an air outlet.

3. The air curtain control system of claim 1, wherein the particular sensor signal is taken from an outside temperature sensor external to the controlled area controlled by the air curtain.

4. The air curtain control system of claim 1, wherein the particular sensor signal is taken from an inside temperature sensor internal to the controlled area controlled by the air curtain.

5. The air curtain control system of claim 1, wherein the particular sensor signal is taken from a nozzle discharge temperature sensor configured to measure a nozzle discharge temperature of the air curtain.

6. The air curtain control system of claim 1, wherein the particular sensor signal is taken from an outside humidity sensor coupled to the air curtain, the external humidity sensor configured to measure an external humidity outside the controlled area controlled by the air curtain.

7. The air curtain control system of claim 1, wherein the particular sensor signal is taken from an inside humidity sensor coupled to the air curtain, the internal humidity sensor configured to measure an internal humidity inside the controlled area controlled by the air curtain.

8. The air curtain control system of claim 1, wherein the air curtain control unit is inside the air curtain.

9. The air curtain control system of claim 1, wherein the air curtain control unit is coupled to the air curtain over a network.

10. The air curtain control system of claim 9, wherein the network comprises one or more of a Building Automation and Control network (BACnet) and a wide area network.

11. The air curtain control system of claim 9, wherein the network comprises one or more of a cellular data network, a Wi-Fi network, and a Bluetooth network.

12. The air curtain control system of claim 9, wherein at least a portion of the control unit is incorporated into a mobile phone, a tablet computing device, a laptop computer, or a desktop computer.

13. The air curtain control system of claim 1, wherein the air curtain control unit comprises user interface elements that facilitate entry of one or more control settings to control the air curtain.

14. The air curtain control system of claim 1, wherein the air curtain control unit comprises a touchscreen display that facilitates entry of one or more control settings to control the air curtain.

15. The air curtain control system of claim 1, wherein the environmental factor correction is provided as part of a time delay mode that allows the air curtain to run when the door is open, and shuts off the air curtain when the door is closed.

16. The air curtain control system of claim 1, wherein the second particular sensor signal is taken from a door monitoring sensor that estimates a rate of ingress or egress based on activity of the door.

17. The air curtain control system of claim 16, wherein the air curtain instruction engine instructs an air curtain motor of the air curtain to keep running for a specified duration of time.

18. The air curtain control system of claim 1, wherein the air curtain is implemented in one or more of a freezer application, an indoor-outdoor application, an inner door application, a pest control application, a custom application, a heater application, and a heat/Air Conditioning (AC) application.

19. A method of controlling an air curtain for a door of a building, the method comprising:

receiving one or more sensor signals, each of the one or more sensor signals containing a representation of a measured environmental factor, a first particular sensor signal of the one or more sensor signals containing a first particular representation of a first particular measured environmental factor of an air outflow in an environment proximate to an air curtain, the air outflow being discharged from the air curtain orthogonal to an ordinary airflow that flows between a controlled area and a uncontrolled area divided by a door of a building, the environment proximate to the air curtain being a part of the controlled area, the air outflow creating a barrier of air capable of preventing movement of one or more entities between the controlled area and the uncontrolled area, a second particular sensor signal of the one or more sensor signals containing a second particular representation of a second particular measured environmental factor, the second particular measured environmental factor including a door open or closed condition of the door;

storing the door open or closed condition and past door open or closed conditions;

receiving, by an air curtain control unit, selection of a particular operation mode of a plurality of operation modes, the plurality of operation modes including at least two different operation modes for controlling the air curtain, at least one of the two different operation modes being based on dependent factors including the measured environmental factor the door open or closed condition, at least one of the past door open or closed conditions, and one or more structural factors of the building;

determining a desired environmental factor of the environment, the desired environmental factor being determined based on the selected particular operation mode;

determining an environmental factor deviation of the measured environmental factor from the desired environmental factor, and to provide an environmental factor correction based on the environmental factor deviation and on the selected particular operation mode;

identifying one or more air curtain components of the air curtain that are operative to assist in implementing the environmental factor correction; and instructing the one or more air curtain components of the air curtain to adjust one or more component settings in order to assist in implementing the environmental factor correction.

20. The method of claim 19, wherein the one or more air curtain components comprise one or more of a heater, an air curtain motor, an air intake, and an air outlet.

21. The method of claim 19, wherein the particular sensor signal is taken from an outside temperature sensor external to the controlled area controlled by the air curtain.

22. The method of claim 19, wherein the particular sensor signal is taken from an inside temperature sensor internal to the controlled area controlled by the air curtain.

23. The method of claim 19, wherein the particular sensor signal is taken from a nozzle discharge temperature sensor configured to measure a nozzle discharge temperature of the air curtain.

24. The method of claim 19, wherein the particular sensor signal is taken from an outside humidity sensor coupled to the air curtain, the external humidity sensor configured to measure an external humidity outside the controlled area controlled by the air curtain.

25. The method of claim 19, wherein the particular sensor signal is taken from an inside humidity sensor coupled to the air curtain, the internal humidity sensor configured to measure an internal humidity inside the controlled area controlled by the air curtain.

26. The method of claim 19, wherein the air curtain control unit is inside the air curtain.

27. The method of claim 19, wherein the air curtain control unit is coupled to the air curtain over a network.

28. The method of claim 27, wherein the network comprises one or more of a Building Automation and Control network (BACnet) and a wide area network.

29. The method of claim 27, wherein the network comprises one or more of a cellular data network, a Wi-Fi network, and a Bluetooth network.

30. The method of claim 27, wherein at least a portion of the air curtain control unit is incorporated into a mobile phone, a tablet computing device, a laptop computer, or a desktop computer.

31. The method of claim 19, wherein the air curtain control unit comprises user interface elements that facilitate entry of one or more control settings to control the air curtain.

32. The method of claim 19, wherein the air curtain control unit comprises a touchscreen display that facilitates entry of one or more control settings to control the air curtain.

33. The method of claim 19, wherein the environmental factor correction is provided as part of a time delay mode that allows the air curtain to run when the door is open, and shuts off the air curtain when the door is closed.

34. The method of claim 19, wherein the second particular sensor signal is taken from a door monitoring sensor that estimates a rate of ingress or egress based on activity of the door.

35. The method of claim 34, further comprising instructing an air curtain motor of the air curtain to keep running for a specified duration of time.

36. The method of claim 19, wherein the air curtain is implemented in one or more of a freezer application, an indoor-outdoor application, an inner door application, a pest control application, a custom application, a heater application, and a heat/Air Conditioning (AC) application.

* * * * *